US007474293B2

(12) United States Patent
Tanaka et al.

(10) Patent No.: US 7,474,293 B2
(45) **Date of Patent: *Jan. 6, 2009**

(54) METHOD OF DRIVING LIQUID CRYSTAL PANEL, AND LIQUID CRYSTAL DISPLAY APPARATUS

(75) Inventors: Shigeki Tanaka, Nara (JP); Shigeki Tamai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 944 days.

This patent is subject to a terminal disclaimer.

(21) Appl. No.: 10/271,594

(22) Filed: Oct. 17, 2002

(65) Prior Publication Data

US 2003/0034947 A1 Feb. 20, 2003

Related U.S. Application Data

(62) Division of application No. 09/274,537, filed on Mar. 23, 1999, now Pat. No. 6,538,630.

(30) Foreign Application Priority Data

Mar. 25, 1998 (JP) ..... P10-076797

(51) Int. Cl.
*G09G 3/36* (2006.01)

(52) U.S. Cl. ..... 345/94; 345/92; 345/96

(58) Field of Classification Search ..... 345/38, 345/87, 96, 89, 97, 92, 104, 100; 359/55
See application file for complete search history.

(56) References Cited

U.S. PATENT DOCUMENTS 4,529,890 A * 7/1985 Kobayashi et al. ..... 327/108
4,752,655 A * 6/1988 Tajiri et al. ..... 345/174
5,274,484 A * 12/1993 Mochizuki et al. ..... 349/33
5,453,757 A * 9/1995 Date et al. ..... 348/89
5,627,457 A 5/1997 Ishiyama et al.
5,642,127 A * 6/1997 Tamai ..... 345/95
5,648,791 A * 7/1997 Date et al. ..... 345/89

(Continued)

FOREIGN PATENT DOCUMENTS

JP 4-11281 A 1/1992

(Continued)

*Primary Examiner*—Sumati Lefkowitz
*Assistant Examiner*—Srilakshmi K Kumar
(74) *Attorney, Agent, or Firm*—Birch, Stewart, Kolasch & Birch, LLP

(57) ABSTRACT

A liquid crystal display apparatus drives an active-matrix liquid crystal panel by the use of the line reversal driving method. To do so, a common driver AC-drives one of a pair of electrode in each of all the pixels of the liquid crystal panel. An adding circuit obtains the sum of a plurality of gradation components for deciding the gradations of the pixels in one of the columns in the liquid crystal panel at intervals of the predetermined horizontal period. A voltage setting portion in a source driver corrects a reference voltage difference ΔVref on the basis of the sum at intervals of the horizontal period, divides the corrected reference voltage difference ΔVrefa, decides a plurality of gradation voltages, and selects voltages to be applied to a plurality of data lines in the liquid crystal panel from among the gradation voltages based on the plurality of gradation components. The selected plurality of voltages are applied to the plurality of data lines.

6 Claims, 17 Drawing Sheets

U.S. PATENT DOCUMENTS

| | | | | |
|---|---|---|---|---|
| 5,828,357 | A | 10/1998 | Tamai et al. | |
| 5,856,814 | A * | 1/1999 | Yagyu | 345/89 |
| 5,892,494 | A * | 4/1999 | Kimura et al. | 345/96 |
| 5,917,238 | A | 6/1999 | Tamai | |
| 6,002,384 | A | 12/1999 | Tamai et al. | |
| 6,538,630 | B1 * | 3/2003 | Tanaka et al. | 345/94 |

FOREIGN PATENT DOCUMENTS

| | | | |
|---|---|---|---|
| JP | 4-118625 | A | 4/1992 |
| JP | 5-341732 | | 12/1993 |
| JP | 6-175612 | A | 6/1994 |
| JP | 7-77950 | A | 3/1995 |
| JP | 7-98577 | A | 4/1995 |
| JP | 7-253765 | A | 10/1995 |
| JP | 8-160392 | A | 6/1996 |

* cited by examiner

FIG.13A PRIOR ART

FIRST FRAME

| ROW \ COLUMN | 1 | 2 | 3 | 4 | 5 |
|---|---|---|---|---|---|
| 1 | + | + | + | + | + |
| 2 | − | − | − | − | − |
| 3 | + | + | + | + | + |
| 4 | − | − | − | − | − |
| 5 | + | + | + | + | + |
| 6 | − | − | − | − | − |

FIG.13B PRIOR ART

NEXT FRAME

| ROW \ COLUMN | 1 | 2 | 3 | 4 | 5 |
|---|---|---|---|---|---|
| 1 | − | − | − | − | − |
| 2 | + | + | + | + | + |
| 3 | − | − | − | − | − |
| 4 | + | + | + | + | + |
| 5 | − | − | − | − | − |
| 6 | + | + | + | + | + |

FIG. 17A PRIOR ART

FIRST FRAME

| ROW \ COLUMN | 1 | 2 | 3 | 4 | 5 |
|---|---|---|---|---|---|
| 1 | + | − | + | − | + |
| 2 | − | + | − | + | − |
| 3 | + | − | + | − | + |
| 4 | − | + | − | + | − |
| 5 | + | − | + | − | + |
| 6 | − | + | − | + | − |

FIG. 17B PRIOR ART

NEXT FRAME

| ROW \ COLUMN | 1 | 2 | 3 | 4 | 5 |
|---|---|---|---|---|---|
| 1 | − | + | − | + | − |
| 2 | + | − | + | − | + |
| 3 | − | + | − | + | − |
| 4 | + | − | + | − | + |
| 5 | − | + | − | + | − |
| 6 | + | − | + | − | + |

METHOD OF DRIVING LIQUID CRYSTAL PANEL, AND LIQUID CRYSTAL DISPLAY APPARATUS

This application is a divisional of application Ser. No. 09/274,537, filed on Mar. 23, 1999, now U.S. Pat. No. 6,538,630 issued Mar. 25, 2003. The entire contents of which are incorporated by reference and for which priority is claimed under 35 U.S.C. § 120; and this application claims priority of application Ser. No. 10-076,797 filed in Japan on Mar. 25, 1998 under 35 U.S.C. § 119.

BACKGROUND OF THE INVENTION

1. Field of the Invention

The present invention relates to a method of driving a liquid crystal panel and a liquid crystal display apparatus for displaying high-quality images when multicolor display or full-color display is performed or when the liquid crystal panel for displaying an image is increased in size.

2. Description of the Related Art

A conventional active-matrix liquid crystal display apparatus using a thin-film transistor (hereinafter, referred to as "TFT") includes a liquid crystal panel comprising a plurality of pixels arranged in a matrix form, and a liquid crystal driving portion for supplying electric signals to the liquid crystal panel. The pixels each have a structure such that liquid crystal is sandwiched between a pixel electrode and a counter electrode. In addition to the plurality of pixels, the liquid crystal panel includes a plurality of scanning lines, a plurality of data lines and a plurality of TFTs. The pixel electrode in each pixel is connected to one of the data lines through one of TFTs. The counter electrodes of all the pixels are interconnected to one another to form one common electrode. The liquid crystal driving portion includes a gate driver for supplying electric signals to the scanning lines, a source driver for supplying electric signals to the data lines, and the common electrode.

FIG. 10 is a block diagram showing the electric structure of the source driver 1. The source driver 1 includes an input latch circuit 2, a shift register 3, a sampling memory 4, a hold memory 5, a D/A converter 6, a gradation-voltage-generating circuit 7 and an output circuit 8. The source driver 1 is supplied with the image data representative of the image to be displayed. The image data comprises data for expressing the brightness, chroma and hue of each image element forming the image. Each image element of the image corresponds to a set of three pixels having red, blue and green color filters, respectively, in the liquid crystal panel. Therefore, each image element data comprises three kinds of gradation components, namely, so-called R (red), G (green) and B (blue) components, and the gradation components represent 64 levels of gradations.

First, the three kinds of gradation components in each image element data are successively supplied to the input latch circuit 2 to be latched. Based on a synchronizing signal SPI supplied from a control circuit disposed outside the source driver 1 through the shift register 3 that operates in response to a clock signal CK, the sampling memory 4 samples the image data latched by the input latch circuit 2. Consequently, a part of the image data which part is associated with an electric signal to be supplied from the source driver 1 to the liquid crystal panel within a single horizontal period 1H, that is, a plurality of gradation components that decide the gradations of a plurality of pixels constituting one of the rows in the liquid crystal panel are stored in the sampling memory 4. The plurality of gradation components are transferred from the sampling memory 4 to the hold memory 5 in synchronism with a synchronizing signal LS of the horizontal period of the liquid crystal panel.

The hold memory 5 latches the plurality of gradation components being transferred, and supplies the plurality of gradation components to the D/A converter 6. The gradation-voltage-generating circuit 7 divides the difference between predetermined two reference voltages Vref1 and Vref2, decides 64 kinds of gradation voltages and supplies the gradation voltages to the D/A converter. The gradation voltages each correspond to one of the 64 levels of gradations that the pixels can take. The D/A converter 6 selects from among the 64 kinds of gradation voltages the gradation voltages that correspond to the gradations shown by the plurality of gradation components being supplied, and supplies the selected gradation voltages to the output circuit 8. The output circuit 8 impedance-converts the selected gradation voltages and charges or discharges the source lines of the liquid crystal panel in accordance with the impedance-converted gradation voltages. Consequently, to the source lines of the liquid crystal panel, electric signals of voltages based on the image data are supplied as so-called data signals.

In each of the pixels, since the pixel electrode and the counter electrode act as electrodes of a capacitor, a capacitance called, for example, parasitic capacitance is present. That is, data signals in accordance with the voltages to be held by the pixels are supplied from the source driver to the data lines and the states of the TFTs are changed, whereby the voltages can be written into the pixels so as to be held by the pixels.

For example, with respect to one of all the TFTs, when the voltage of an electric signal, namely, a so-called scanning signal, supplied from the gate driver to the scanning line to which the gate terminal of the TFT is connected becomes positive, a positive voltage is applied to the gate terminal, so that the one of the TFTs changes to a so-called ON state. Consequently, the pixel including the pixel electrode to which the one of the TFTs is connected is charged by the voltage applied to the data line to which the one of the TFTs is connected. When the voltage of the scanning signal becomes negative, a negative voltage is applied to the gate terminal, so that the one of the TFTs changes to so-called OFF state. Consequently, the voltage between the pixel electrode and the counter electrode in the pixel is maintained at the voltage applied between the pixel electrode and the counter electrode when the one of the TFTs changes to OFF state. As a result, the voltage to be held is written into the pixel. The transmittance of the liquid crystal layer in the pixel, that is, the gradation of the pixel is decided in accordance with the voltage held by the pixel. Therefore, by controlling the gradations of all the pixels in the liquid crystal panel by the voltages held by the pixels, an image is displayed on the liquid crystal panel.

The liquid crystal panel is reversely driven in order that the liquid crystal is not polarized. Reverse driving methods include a so-called dot reversal driving method and a so-called line reversal driving method. In the description that follows, it is assumed that the pixels of the liquid crystal panel are arranged in 6 rows and 5 columns.

First, the behavior of the liquid crystal display apparatus of the above-described structure when the liquid crystal display apparatus is driven by the line reversal driving method will be described. FIG. 11 shows a timing chart of a plurality of scanning signals 11*a* to 11*f* supplied from the gate driver in the liquid crystal display apparatus to six scanning lines. FIG. 12 shows a timing chart of one scanning signal 11 of the scanning signals 11*a* to 11*f*, one data signal 12 of a plurality of data signals supplied from the source driver 1 to five data lines, and a voltage 13 applied to the common electrode in the liquid crystal display apparatus. FIGS. 11 and 12 will be described together.

The scanning signals 11*a* to 11*f* are held at high level during a predetermined single horizontal period WH at intervals of a predetermined frame display period CH, and are held at low level during the remaining period. The timing where the plurality of scanning signals 11*a* to 11*f* are held at high level within a time period corresponding to one cycle of a horizontal synchronization cycle differs among the signals. Therefore, to all the pixels in the row of pixels on one of the scanning lines, the voltage to be held is written while the scanning signal supplied to the one of the scanning lines is held at a high level. The row as pixels on one of the scanning lines is a set of a plurality of pixels including pixel electrodes connected to the drain terminals of a plurality of TFTs whose gate terminals are connected to the one of the scanning lines.

The cycle of the alternating component of the voltage 13 applied to the common electrode equals the horizontal period WH. That is, when the line reversal driving method is used, the common electrode is AC-driven in a cycle the same as the horizontal period WH by a single 5-V power source. The alternating component of the data signal 12 changes in a predetermined cycle that is shorter than the horizontal period WH around the center of amplitude of the alternating component of the voltage 13 applied to the common electrode. The amplitude of the alternating component of the data signal 12 varies according to the gradation of the pixel. The alternating component of a data signal 12*a* of a case where the gradation of the pixel is maximum, that is, a case where the pixel represents black is opposite in polarity to the alternating component of a data signal 12*b* of a case where the gradation of the pixel is minimum, that is, a case where the pixel represents white. The amplitudes of the data signals 12*a* and 12*b* of the cases where the gradation of the pixel is maximum and where the gradation is minimum are both smaller than the amplitude of the alternating component of the voltage 13 applied to the common electrode.

The arrow 14 indicates the polarity of the current flowing through the pixel in order to write the voltage to be held into the pixel, that is, whether or not the voltage held by the data line is higher than the voltage held by the common electrode when the voltage to be held is written into the pixel. When the arrow 14 points upward, since the voltage of the data line is higher than the voltage of the common electrode, the polarity is positive. When the arrow 14 points downward, since the voltage of the data line is lower than the voltage of the common electrode, the polarity is negative. When the polarity is positive, the current flows from the data line through the pixel to the common electrode. When the polarity is negative, the current flows from the common electrode through the pixel to the data line.

FIG. 13A shows the polarities of the currents in all the pixels. The currents are for writing the voltages to be held into all the pixels in the liquid crystal panel in a given frame in case where the liquid crystal display apparatus is driven by the use of the line reversal driving method. FIG. 13B shows the polarities of the currents in all the pixels in a frame next to the frame of FIG. 13A in the above-mentioned case. The plural rectangles arranged in a matrix correspond to the pixels in the liquid crystal panel of 6 rows and 5 columns. The rows of the rectangles correspond to the rows of pixels. The columns of the rectangles correspond to the columns of pixels, that is, sets of all the pixels including the pixel electrodes connected to one given data line through the TFTs. When the polarity of the current flowing through a pixel is positive, "+" is drawn in the rectangle corresponding to the pixel. When the polarity is negative, "−" is drawn in the rectangle.

The polarity of the current flowing through one given pixel of the liquid crystal panel is reversed between the first frame and the next frame. In both of the first and the next frames, the polarities of the currents flowing through two adjoining pixels in one column are different from each other and the polarities of the currents flowing through all the pixels in one row are equal to one another. Consequently, the currents concentrate at the common electrode, so that a voltage drop is apt to occur at the common electrode. When a voltage drop occurs, it is impossible to correctly write the voltages to be held into the pixels, so that the display quality of the liquid crystal display apparatus is reduced.

A cause of display quality reduction of the liquid crystal display apparatus when the liquid crystal display apparatus is driven by the use of the line reversal driving method will be described in detail by the use of an equivalent circuit of the liquid crystal display apparatus of FIG. 14. In FIG. 14, it is assumed that the pixels of a liquid crystal panel 20 are arranged in 2 rows and 2 columns, and the common electrode is shown as a plurality of counter electrodes 22 successively connected by conductors 25 each having an internal resistance component rc.

For example, it is assumed that the voltages to be held are written into pixels 21*a* and 21*b* on the first scanning line 24*a* from the top by a positive-polarity current. In this case, the voltage of the scanning signal supplied to the first scanning line 24*a* based on an output 23*a* from the gate driver is a voltage capable of turning on the TFTs, whereas the voltage of the scanning signal supplied to the second scanning line from the top based on an output 23*b* from the gate driver is a voltage capable of turning off the TFTs. In the above-described case, the currents flowing into the pixels 21*a* and 21*b* of the row on the first scanning line 24*a* flow, as shown by the broken line 30, from data lines 26*a* and 26*b* through TFTs 27*a* and 27*b* and pixels 28*a* and 28*b* to parts 29 on the side of the common electrode.

As described above, when the polarities of the currents written into all the pixels of the row on one given scanning line are equal to one another, the directions of the currents flowing through all the pixels are equal to one another. Therefore, the currents flowing out of all the pixels concentrate at the common electrode, so that a voltage drop occurs due to the resistance components rc of the conductors 25 interposed between the counter electrodes 22 and the internal resistance Rc of the parts 29 on the side of the common electrode. Consequently, as shown in FIG. 15, the actual voltage $V\alpha$ between the common electrode and the pixel electrode is lower than the difference $V\beta$ between the voltage of the data signal and the voltage applied to the common electrode by the amount $V\gamma$ of the voltage drop. That is, the voltage actually held by the common electrode is closer to the voltage of the common electrode than a voltage to be intrinsically held by the pixel electrode by the voltage drop amount $V\gamma$.

The voltage drop amount $V\gamma$ varies according to the voltage of the data signal. For example, the voltage drop amount $V\gamma$ is largest when all of the voltages of all the data signals supplied to the liquid crystal panel within the horizontal period WH are the highest pixel voltage of the pixel voltages of the 64 gradations. Moreover, for example, the voltage drop amount is smallest when all of the voltages of all the data signals are the lowest pixel voltage of the pixel voltages of the 64 gradations. The levels of all the data signals are decided in accordance with the gradation distribution of the image elements of one of the rows in the image represented by the image data and the gradation distributions of the image elements of the rows in the image frequently differ from one another. Therefore, the levels of all the data signals change at intervals of a horizontal period, that is, every time the row into which the voltage to be held is written is changed.

Consequently, when a sheet of image is displayed on the liquid crystal panel, so-called gradation nonuniformity is caused in the image. Further, when an image in which there is a black window against a halftone background is displayed on the liquid crystal display apparatus, the peripheral part of the black window in the background is whiter than the part other than the peripheral part in the background. Therefore, in the above-described case, so-called lateral shadowing becomes a problem. From the above, when the liquid crystal display apparatus is driven by the use of the line reversal driving method, the display quality of the liquid crystal display apparatus is reduced.

Hereinafter, the behavior of the liquid crystal display apparatus of the above-described structure when the liquid crystal apparatus is driven by the dot reversal driving method will be described. FIG. 16 shows a timing chart of a scanning signal 31, a data signal 32 and a voltage 33 applied to the common electrode in the liquid crystal display apparatus. The definitions of the signals 31, 32*a*, 32*b* and 33 and the definition of the arrow 34 are the same as the definitions of the signals 11, 12*a*, 12*b* and 13 and the definition of the arrow 14 of FIG. 12, respectively. The scanning signal 31 is the same as the scanning signal 11 of FIG. 12. The alternating component of the data signal 32 changes in a cycle shorter than the horizontal period WH. The voltage 33 applied to the common electrode is always held at the center of amplitude of the alternating component of the data signal 32. Therefore, the liquid crystal display apparatus is driven so that the voltage of the common electrode is always the same and that the voltages of all the pixel electrodes are symmetrical with respect to the voltage of the common electrode.

FIG. 17A shows the polarities of the currents in all the pixels which currents are for writing the voltages to be held into all the pixels in the liquid crystal panel in a given frame in a case where the liquid crystal display apparatus is driven by the use of the dot reversal driving method. FIG. 17B shows the polarities of the currents in all the pixels in a frame next to the frame of FIG. 17A in the above-mentioned case. The definitions of the rectangles, "+" and "−" of FIGS. 17A and 17B are the same as the definitions of the rectangles, "+" and "−" of FIGS. 13A and 13B.

The polarities of the currents flowing through the pixels of the liquid crystal panel differ between the first frame and the next frame. In both of the first and the next frames, the polarities of the currents flowing through two adjoining pixels in one column are different from each other and the polarities of the currents flowing through two adjoining pixels in one row are different from each other. Consequently, when the voltages are written into all the pixels in the row on one of the scanning lines, the directions of flow of the currents for writing the voltages into two adjoining pixels are opposite to each other, so that the currents flowing from the two adjoining pixels cancel each other out. Therefore, the voltage of the common electrode is stabilized, so that the voltage held by the pixel electrode does not vary.

Conventional liquid crystal display apparatuses of which liquid crystal panel is driven by the use of the dot reversal driving method include an active-matrix liquid crystal display apparatus of Japanese Publication for Laid-Open Patent Application Hei 5-341732 (1993). In this liquid crystal display apparatus, in accordance with the amplitude of the alternating component of the data signal, the voltage of the common electrode is regulated so as to be always the same as the center of voltage variation of the pixel electrode.

In a liquid crystal display apparatus using the dot reversal driving method, for example, the active-matrix liquid crystal display apparatus of JP-A 5-341732, the integrated circuit constituting the source driver requires a driving voltage approximately twice the driving voltage required by the integrated circuit constituting the source driver in the liquid crystal display apparatus using the line reversal driving method. Therefore, while a so-called low withstand process can be used for the latter integrated circuit, it is necessary to use an intermediate withstand process for the former integrated circuit. Therefore, the size of the integrated circuit of the liquid crystal display apparatus using the dot reversal driving method is larger than the size of the integrated circuit of the liquid crystal display apparatus using the line reversal driving method, and the number of masks necessary for manufacturing the former integrated circuit is greater than the number of masks necessary for manufacturing the latter integrated circuit. Consequently, the manufacturing process of the integrated circuit of the liquid crystal display apparatus using the dot reversal driving method is more complicated than the manufacturing process of the integrated circuit of the liquid crystal display apparatus using the line reversal driving method.

From these, the manufacturing cost of the integrated circuit of the liquid crystal display apparatus using the dot reversal driving method is higher than the manufacturing cost of the integrated circuit of the liquid crystal display apparatus using the line reversal driving method. Moreover, since the integrated circuit of the liquid crystal display apparatus using the dot reversal driving method employs the intermediate withstand process, it is necessary that the power circuit for supplying power for driving the integrated circuit withstand higher voltages than conventional power circuits. For this reason, it is necessary to newly develop a power circuit that withstands voltages of at least 10 V.

As described above, when the liquid crystal display apparatus of the above-described structure is driven by the use of the line reversal driving method, the display quality of the liquid crystal display apparatus is reduced due to shadowing and nonuniformity in brightness. When the liquid crystal display apparatus of the above-described structure is driven by the use of the dot reversal driving method, it is impossible to use the low withstand process for the driver in the liquid crystal driving portion, so that the manufacturing cost of the liquid crystal display apparatus increases.

SUMMARY OF THE INVENTION

An object of the invention is to provide a liquid crystal display apparatus and a method of driving a liquid crystal panel capable of preventing the display quality from being reduced and capable of reducing the manufacturing cost of the liquid crystal driving portion.

The invention provides a method of driving a liquid crystal panel which includes a plurality of pixels arranged in a matrix form, the plurality of pixels each being composed of a pair of electrodes and liquid crystal sandwiched therebetween, and being divided into a plurality of pixel groups each composed of plural pixels, the method comprising:

performing a predetermined computing operation at intervals of a predetermined horizontal period by the use of gradation data representative of gradations of pixels of one of the pixel groups;

correcting a voltage decided on the basis of gradation data of each pixel of the one pixel group, on the basis of a result of the computing operation, to obtain a corrected voltage thereof; and applying the corrected voltage between a pair of electrodes of each pixel of the one of the pixel groups during the horizontal period.

According to the invention, the liquid crystal panel is driven by the above-described driving method. Consequently, the voltage between the pair of electrodes for each pixel of the one pixel group is corrected on the basis of the computation result. Consequently, even when a voltage between the pair of electrodes of each pixel of the one pixel group varies due to the gradation data for the one pixel group, the voltage between the pair of electrodes of each pixel can be made a voltage which is in accordance with the gradation represented by the gradation data for the one pixel group. As a result, when the display panel is driven by the driving method, the display quality of the liquid crystal panel is enhanced as compared with that by the conventional driving method.

The invention is characterized in that the computing operation is an operation of adding the gradation data.

According to the invention, in the method of driving a liquid crystal panel, the gradation data is added to one another. Consequently, the correction voltages are obtained based on the gradation data and the sum of the gradation data. That is, the voltage between the pair of electrodes in each pixel of the one of the pixel groups is corrected based on the sum of the plurality of gradation data. As a result, the computing operation of the gradation data is facilitated.

The invention provides a liquid crystal display apparatus comprising:

a liquid crystal panel constituted of a plurality of pixels arranged in a matrix form, the plurality of pixels each including a pair of electrodes and liquid crystal sandwiched therebetween, and being divided into a plurality of pixel groups each composed of plural pixels, computing means for performing a predetermined computing operation at intervals of a predetermined horizontal period by the use of gradation data representative of gradations of pixels of one of the pixel groups;

correction voltage setting means for correcting a voltage decided on the basis of gradation data of each pixel of the one pixel group, on the basis of a result of the computing operation, to obtain a corrected voltage thereof; and voltage applying means for applying the corrected voltage between a pair of electrodes of each pixel of the one of the pixel groups during the horizontal period.

According to the invention, the liquid crystal display apparatus includes the above-described constitution. Therefore, the voltage between the pair of electrodes in each pixel of one of the pixel groups is corrected based on the result of the computing operation every horizontal period. Consequently, the voltage between the pair of electrodes in each pixel can be made a voltage that is in accordance with the gradations represented by the gradation data even when the voltage of one of the pair of electrodes in each pixel varies due to the gradation data. As a result, the liquid crystal display apparatus is better than the conventional liquid crystal display apparatus in display quality.

The invention is characterized in that the computing operation is an operation of adding the gradation data.

According to the invention, the computing means of the liquid crystal display apparatus obtains the sum of the gradation data. Consequently, the corrected voltage is obtained based on each gradation data and the sum of the gradation data. As a result, the structure of the computing means is simplified and the computing operation is facilitated.

The invention is characterized in that the liquid crystal display apparatus further comprises correction signal generating means for generating a correction signal associated with correction of the voltage on the basis of the result of the computing operation and supplying the correction signal to the correction voltage setting means in synchronism with the horizontal period, and the correction voltage setting means obtains the correction voltage on the basis of the gradation data and the correction signal every time the correction signal is supplied.

According to the invention, the liquid crystal display apparatus comprises the correction signal generating means for outputting the correction signal representative of the result of the computing operation in synchronism with the horizontal period which is interposed between the computing means and the correction voltage setting means. Consequently, the correction voltage setting means can obtain the correction voltage at intervals of the horizontal period in response to the correction signal instead of in response to the result of the computing operation by the computing means. That is, the correction voltage setting means can obtain the correction voltage in synchronism with the horizontal period.

The invention is characterized in that the computing means outputs a bit string representative of the result of the computing operation and that the correction signal generating means generates the correction signal on the basis of a part of bits of the bit string.

According to the invention, the correction signal generating means of the liquid crystal display apparatus generates the correction signal by the use of only a part of the bits of the bit string representative of the result of the computing operation. Consequently, the number of bits of a bit string representative of the correction signal is smaller than the number of bits of the bit string representative of the result of the computing operation. As a result, the number of input terminals of the correction voltage setting means of a case where the correction signal is supplied can be made smaller than the number of input terminals of the correction voltage setting means of a case where the result of the computing operation is directly supplied, and the circuit scale of the liquid crystal display apparatus of the case where the correction signal is supplied can be made smaller than the circuit scale of the liquid crystal display apparatus of the case where the result of the computing operation is directly supplied. When the correction signal is generated by the use of only a part of the bits, the closer the number of bits of the part is to the number of all the bits of the bit string representative of the result of the computing operation, the higher the accuracy of the correction voltage is.

The invention is characterized in that the computing means outputs a bit string representative of the result of the computing operation and that the correction signal generating means generates the correction signal on the basis of all the bits of the bit string.

According to the invention, the correction signal generating means of the liquid crystal display apparatus generates the correction signal by the use of all the bits of the bit string representative of the result of the computing operation. In this case, the correction signal generating means may output the bit string as the correction signal as it is or may generate a correction signal including bits fewer in number than the bits of the bit string by performing computing operations on all the bits. Consequently, the correction voltage set by the correction voltage setting means is highest in accuracy. As a result, a highest-display-quality liquid crystal display apparatus can be attained.

The invention is characterized in that the liquid crystal display apparatus further comprises a reference power source for generating a predetermined reference voltage, and that the correction voltage setting means comprises:

reference voltage correcting means for correcting the reference voltage on the basis of the result of the computing operation;

voltage dividing means for dividing the corrected reference voltage to obtain a plurality of divisional voltages in accordance with all the gradations that the pixels can take; and selecting means for selecting from among the plurality of divisional voltages a plurality of divisional voltages in accordance with the gradation represented by each gradation data as the correction voltages.

According to the invention, the correction voltage setting means of the liquid crystal display apparatus has the above-described structure. Consequently, since the reference voltage is corrected based on the result of the computing operation, the plurality of divisional voltages correspond to the voltages obtained by correcting based on the result of the computing operation the voltages corresponding to all the gradations that the pixels can take. As a result, the correction voltage setting means can easily set the correction voltage.

The invention is characterized in that the reference voltage correcting means and the voltage dividing means are formed in a single integrated circuit.

According to the invention, the reference voltage correcting means and the voltage dividing means are formed on a single integrated circuit. This is for the following reasons: Generally, when a multiplicity of integrated circuits are manufactured, there are variations in characteristics of parts in the integrated circuits, for example, resistance values of the resistors due to the manufacturing process of the integrated circuits. Therefore, when the reference voltage correcting means and the voltage dividing means are formed in two different integrated circuits, the variations in characteristics of parts differ between the reference voltage correcting means and the voltage dividing means. However, when the reference voltage correcting means and the voltage dividing means are formed in a single integrated circuit, the variations in characteristics of parts are the same between the reference voltage correcting means and the voltage dividing means. Therefore, the variations in characteristics in the entire correction voltage setting means are smaller when the reference voltage correcting means and the voltage dividing means are formed in a single integrated circuit than when the reference voltage correcting means and the voltage dividing means are formed in two different integrated circuits. That is, the variations in characteristics of parts due to the manufacturing processing of the integrated circuits can be restrained in the entire correction voltage setting means. Moreover, since the number of integrated circuits in the liquid crystal display apparatus is smaller when the reference voltage correcting means and the voltage dividing means are formed in one integrated circuit than when the reference voltage correcting means and the voltage dividing means are formed in two different integrated circuits, the cost of the parts is reduced and the assembly of the liquid crystal display apparatus is facilitated. From these, it is preferable that the reference voltage correcting means and the voltage dividing means be formed in a single integrated circuit.

The invention provides a liquid crystal display apparatus comprising:

a liquid crystal panel constituted of a plurality of pixels arranged in a matrix form, the plurality of pixels each being composed of a pair of electrodes and liquid crystal sandwiched therebetween, and being divided into a plurality of pixel groups each composed of plural pixels, first voltage holding means for causing one of the pair of the electrodes of each of all the pixels to hold a first voltage that is changed at intervals of a predetermined horizontal period;

computing means for performing a predetermined computing operation at intervals of a predetermined horizontal period by the use of gradation data representative of gradations of pixels of one of the pixel groups;

second voltage setting means for obtaining at intervals of the horizontal period a second voltage by correcting on the basis of a result of the computing operation by the computing means a voltage decided on the basis of the gradation data and the first voltage; and second voltage holding means for causing the other one of the pair of electrodes of each of all the pixels in one of the pixel groups to hold the second voltage during the horizontal period.

According to the invention, the first voltage holding means of the liquid crystal display apparatus supplies the voltage that is changed at intervals of the horizontal period, to one of the electrodes in each pixel. That is, the liquid crystal display apparatus uses the so-called line reversal driving method. Therefore, the structure for driving the liquid crystal panel in the liquid crystal display apparatus, namely the first voltage holding means and the second voltage holding means can be realized by so-called low withstand process. Moreover, since the second voltage is supplied to the other one of the electrodes in each pixel, the voltage between the pair of electrodes in each pixel is a voltage obtained by correcting based on the result of the computing operation a voltage decided based on the gradation data. Therefore, for example, the quality degradation of the image displayed on the liquid crystal panel due to shadowing or nonuniformity in brightness is prevented. As a result, the liquid crystal display apparatus of the invention is better than the conventional liquid crystal display apparatus using the line reversal driving method in display quality.

From these, in the liquid crystal display apparatus of the invention, a better-display-quality liquid crystal panel can be made than that in the conventional liquid crystal display apparatus using the line reversal driving method, and the cost of the structure for driving the liquid crystal panel can be made lower than that of the structure of the conventional liquid crystal display apparatus using the dot reversal driving method. Moreover, in the liquid crystal display apparatus of the invention, the display quality is prevented from being reduced when the size of the liquid crystal panel is increased and when the number of pixels in the liquid crystal panel is increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other and further objects, features, and advantages of the invention will be more explicit from the following detailed description taken with reference to the drawings wherein:

FIGS. 13A and 13B are views showing the polarities of the currents flowing through all the pixels in the liquid crystal panel in a given frame and a frame next to the frame when the liquid crystal display apparatus 1 is driven by the use of the line reversal driving method;

FIGS. 17A and 17B are views showing the polarities of the currents flowing into all the pixels in the liquid crystal panel in a given frame and a frame next to the frame when the liquid crystal display apparatus 1 is driven by the use of the dot reversal driving method.

DETAILED DESCRIPTION OF THE PREFERRED EMBODIMENTS

Figure 1:
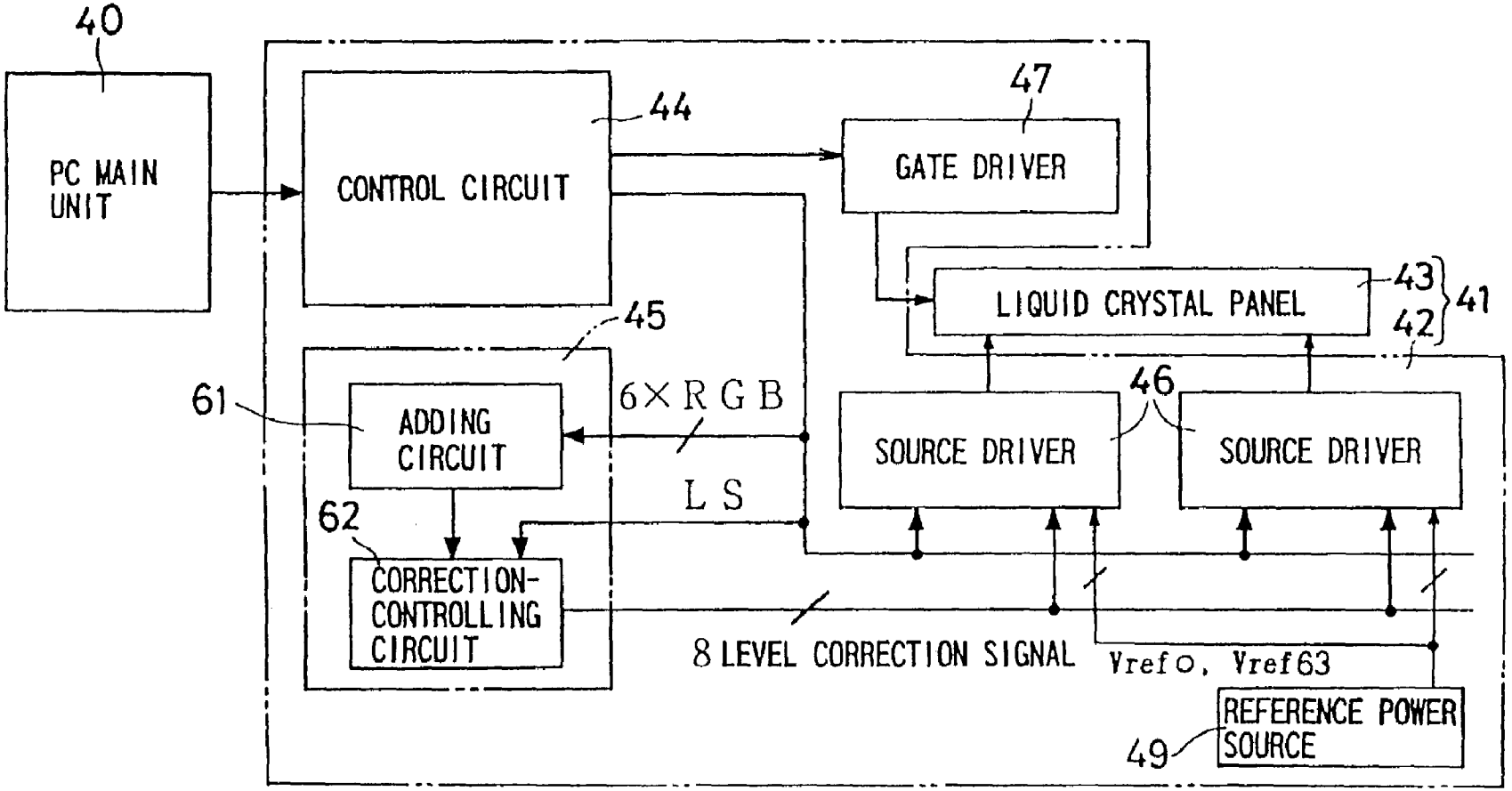
FIG. 1 is a block diagram showing the electric structure of a liquid crystal display apparatus 41 according to an embodiment of the invention.

Now referring to the drawings, preferred embodiments of the invention are described below.

Figure 2:
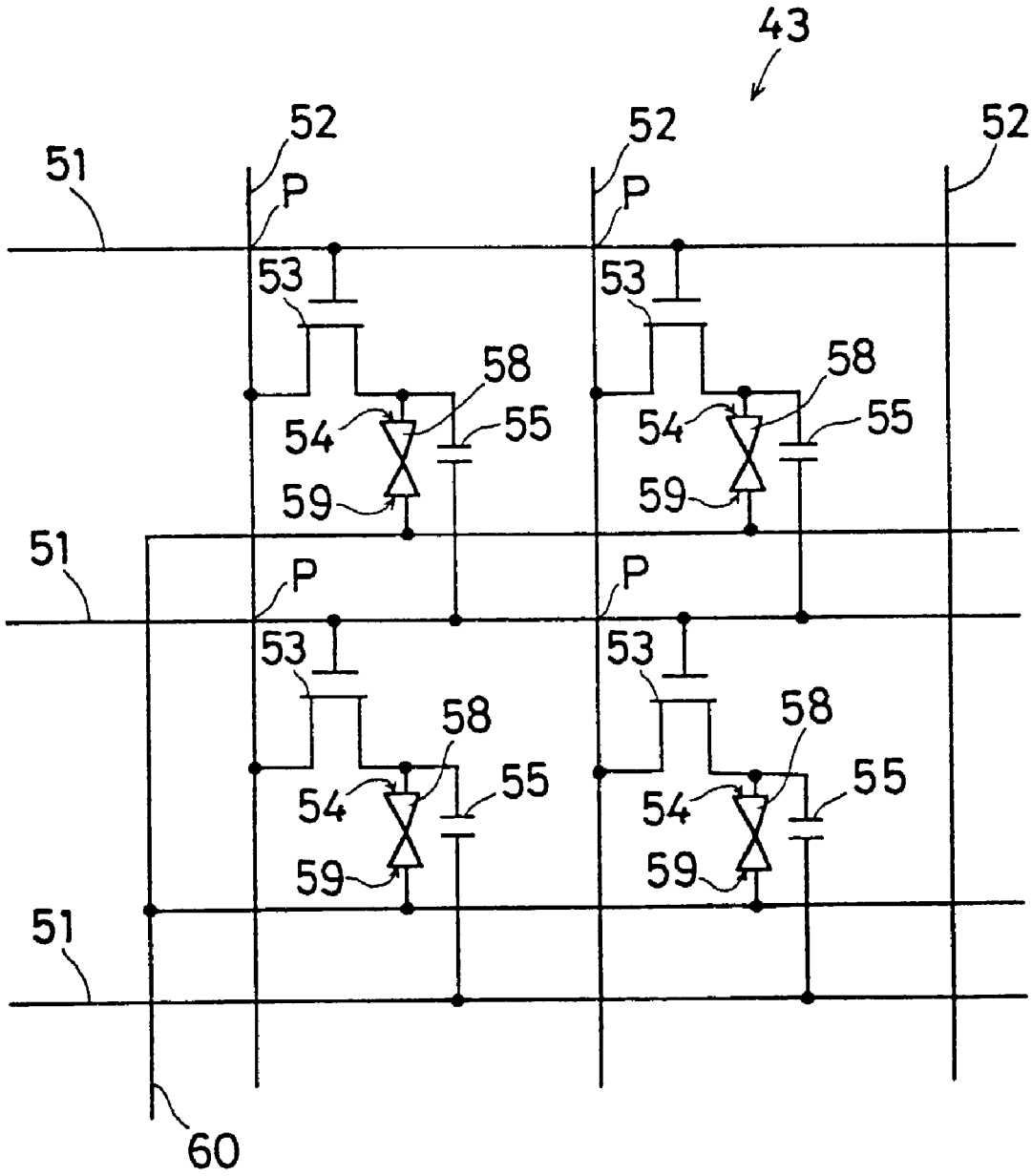
FIG. 2 is a view showing an equivalent circuit of a liquid crystal panel 43 provided in the liquid crystal display apparatus 41.
Figure 3:
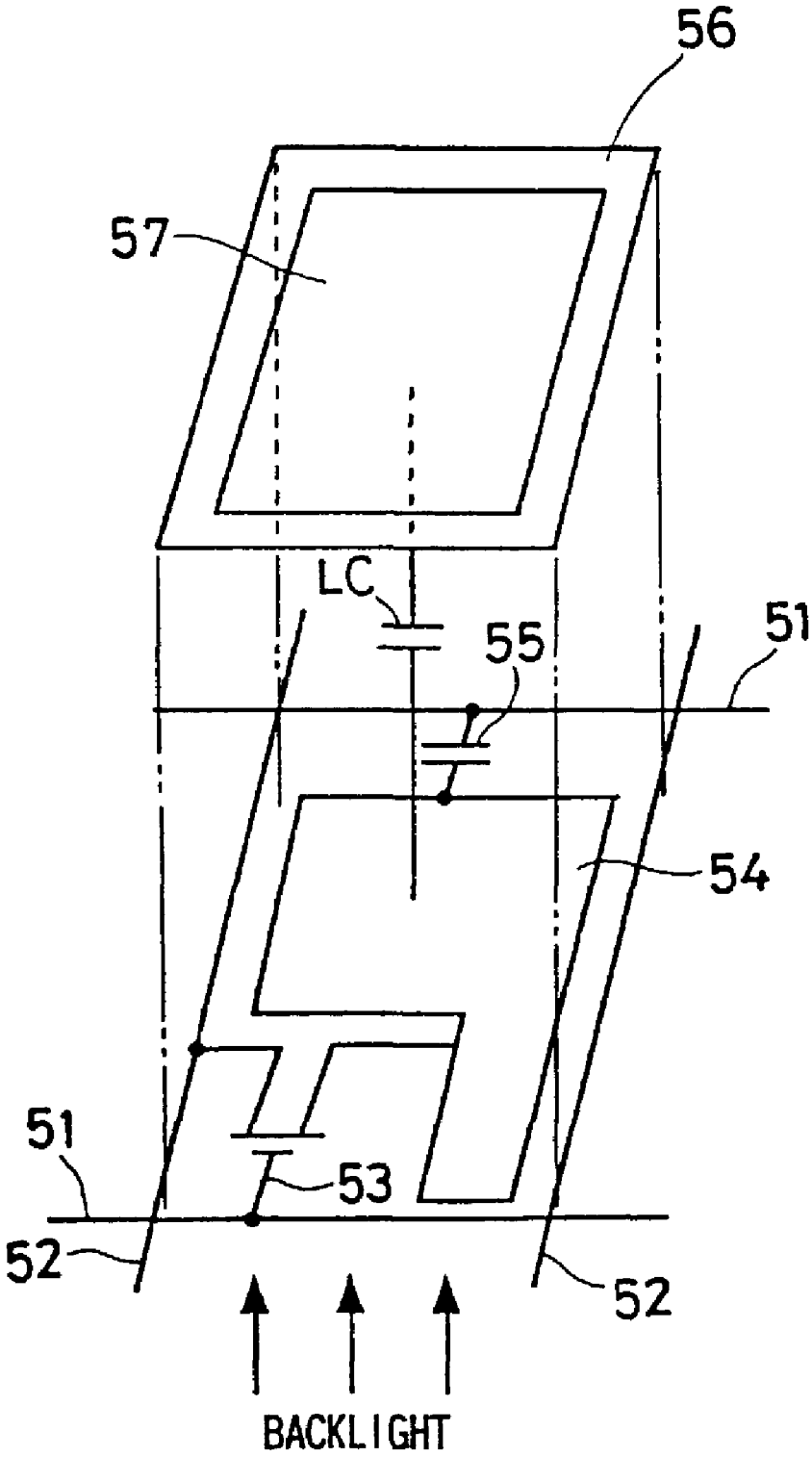
FIG. 3 is a schematic view showing the structure of one given pixel 58 in the liquid crystal panel 43 and the structure of a peripheral part of the pixel 58 in the liquid crystal panel 43.

FIG. 1 is a block diagram showing the electric structure of a liquid crystal display apparatus 41 according to an embodiment of the invention. FIG. 2 is a view showing an equivalent circuit of a liquid crystal panel 43 in the liquid crystal display apparatus 41. FIG. 3 is a schematic view showing the structure of a single pixel in the liquid crystal panel 43 and the structure of a peripheral part of the pixel in the liquid crystal panel 43. FIGS. 1 to 3 will be described together. The liquid crystal display apparatus 41 is connected, for example, to a computer main unit 40 so as to be used as a display apparatus for the computer main unit 40.

The liquid crystal display apparatus 41 includes the liquid crystal panel 43 and a driving portion 42. The driving portion 42 includes a control circuit 44, a level correction computing circuit 45, a source driver 46, a gate driver 47 and a reference power source 49. In this embodiment, it is assumed that the liquid crystal panel 43 is a so-called XGA panel capable of color display. While the source driver 46 is divided into two integrated circuits in this embodiment, the source driver 46 may be a single integrated circuit or may be divided into three or more integrated circuits.

The liquid crystal panel 43 has a structure such that a liquid crystal layer is sandwiched between a pair of substrate members. One of the pair of substrate members includes one main substrate, a plurality of scanning lines 51, a plurality of data lines 52, a plurality of thin-film transistors (hereinafter, referred to as "TFTs") 53, a plurality of pixel electrodes 54, and a plurality of auxiliary capacity portions 55. The other one of the pair of substrate members includes one transparent counter substrate, one common electrode 56 and color filters 57.

The plurality of scanning lines 51, the plurality of data lines 52, the plurality of TFTs 53, the plurality of pixel electrodes 54 and the plurality of auxiliary capacity portions 55 are arranged on one surface of the main substrate in the manner described below. The plurality of scanning lines 51 are arranged parallel to one another. The plurality of data lines 52 are arranged parallel to one another and vertically to the scanning lines 51. The plurality of TFTs 53 are disposed one in the vicinity of each of a plurality of intersections P of the scanning lines 51 and the data lines 52. The plurality of pixel electrodes 54 are arranged parallel to the scanning lines 51 and the data lines 52, so that the pixel electrodes 54 are arranged in a matrix. The gate terminal and the source terminal of each of the TFTs 53 are connected to a single scanning line 51 and a single data line 52 situated closest to the TFT 53, respectively. The pixel electrodes 54 are connected to the drain terminals of the TFTs 53. The auxiliary capacity portions 55 are capacitors, and are interposed between the pixel electrodes 54 and the scanning lines 51 other than the scanning lines 51 to which the pixel electrodes 54 are connected through the TFTs 53. The common electrode 56 is disposed on one surface of the counter substrate. The color filters are disposed on one surface of the counter substrate. The one surface of the main substrate and the one surface of the counter substrate are opposed to each other with a liquid crystal layer LC therebetween.

The portions of the liquid crystal panel 43 where the pixel electrodes 54 are opposed to the common electrode 56 with the liquid crystal layer therebetween act as the pixels 58. That is, the common electrode 56 is common to all the pixels 58. The portions of the common electrode 56 that are opposed to the pixel electrodes 54 will be referred to as counter portions 59. The color filters 57 are disposed so that one color filter 57 is superposed on each pixel when the liquid crystal panel 43 is viewed from a direction parallel to the normal of the one surface of the counter substrate. In the equivalent circuit of FIG. 2, the common electrode 56 is shown as all the counter portions 59 connected by conductors 60 each having a resistance component rc.

The pixels 58 are all arranged in a matrix in the liquid crystal panel 43. A set of a plurality of pixels 58 linearly arranged in a direction parallel to the scanning lines 51 will be referred to as a "row", whereas a set of a plurality of pixels 58 linearly arranged in a direction parallel to the data lines 52 will be referred to as a "column". In FIG. 3, the main substrate and the counter substrate are not shown. In this embodiment, since the liquid crystal panel 43 is an XGA panel capable of color display, the pixels 58 are arranged in a matrix with 768 rows and 1028×RGB columns, and the color filters 57 are formed so as to include a plurality of red, blue and green filters. Given three pixels on which single red, blue and green filters are superposed correspond to one given pixel of a plurality of pixels constituting a color image to be displayed on the liquid crystal panel 43, and the brightness, the hue and the chroma of the one pixel can be expressed by adjusting the gradations of the three image elements.

The gradation of one of the pixels 58 is decided in accordance with the voltage between the pair of electrodes in the pixel 58, that is, the difference ΔV between the voltage held by the counter portion 59 and the voltage held by the pixel electrode 54. In this embodiment, it is assumed that the higher the gradation of one of the pixels 58 is, the higher the voltage ΔV between the pair of electrodes 54 and 59 in the pixel 58 is. That is, it is assumed that the higher the gradation of one of the pixels 58 is, the farther the voltage held by one data line 52 connected to the pixel electrode 54 in the pixel 58 through the TFT 53 is away from the voltage held by the common electrode 56.

The control circuit 44 converts the image data supplied from the computer main unit 40 into a video signal of a configuration that can be handled in the liquid crystal display apparatus 41. In this embodiment, it is assumed that the video signal is a so-called 6 bits×RGB video signal. That is, the video signal includes image element data for expressing the brightness, chroma and hue of each of a plurality of image elements constituting the color image represented by the image data. It is assumed that each image element data includes three gradation components for deciding the gradations of the three pixels, that is, the R component, the G component and the B component. The gradation of each of the pixels 58 is selected from among predetermined plural levels of gradations that the pixels 58 can take. In this embodiment, it is assumed that each of the gradation components is 6-bit data and represents one of 64 levels of gradations. The video signal is supplied from the control circuit 44 to the level correction computing circuit 45 and to the source driver 46.

The reference power source 49 outputs predetermined first and second reference voltages Vref0 and Vref63. One of the first and the second reference voltages Vref0 and Vref63 may be of ground level. The level correction computing circuit 45, briefly, generates a correction signal associated with gradation voltage correction in accordance with the video signal. To do this, the level correction computing circuit 45 includes an adding circuit 61 and a correction-controlling circuit 62.

Every time a single horizontal period 1H elapses, the adding circuit 61 captures a data input portion used for deciding the gradations of all the pixels within the horizontal period (in the row on one of the scanning lines). The portion includes gradation components the number of which is the same as the number of all the pixels in one of the rows. Hereinafter, the portion will be referred to as "unit portion". The adding circuit 61 adds all the gradation components in the captured unit portion at intervals of the horizontal period 1H. That is, the adding circuit 61 obtains the sum of the numerical values corresponding to the gradations shown by all the gradation components in the unit portion. The adding circuit 61 supplies the correction-controlling circuit 62 with at least a part of a bit string representative of the sum. In this embodiment, the part is the highest eight digits of the bit string representative of the sum. The correction-controlling circuit 62 generates the correction signal based on the part of the bit string representative of the sum, and supplies the correction signal to the source driver 46.

In the description that follows, it is assumed that when all the bits in the bit string representative of one given gradation component are "1", the gradation shown by the gradation component is the maximum gradation of the 64 levels of gradations that the pixels can take and that when all the bits in the bit string representative of one given gradation component are "0", the gradation shown by the gradation component is the minimum gradation of the 64 levels of gradations that the pixels can take. Moreover, it is assumed that the numerical value corresponding to the maximum gradation is "63" in decimal notation and that the numerical value corresponding to the minimum gradation is "0" in decimal notation. For example, when all the bits in the bit string representative of the unit portion are 1, all of the gradations shown by the gradation components in the unit portion are the maximum gradation. In this case, as shown by expression (1), the sum of all the gradation components in the unit portion is "193536" in decimal notation and "11111010000000000" in binary notation.

$$6\ \text{bits} \times RGB \times 1024\ \text{pixels} = 63 \times 3 \times 1024 = 193536 \quad (1)$$

The source driver 46 receives the correction signal at intervals of the horizontal period 1H and corrects an output voltage. The data signals become correction voltages corresponding to the gradations shown by the gradation components in the unit portion.

Figure 11:
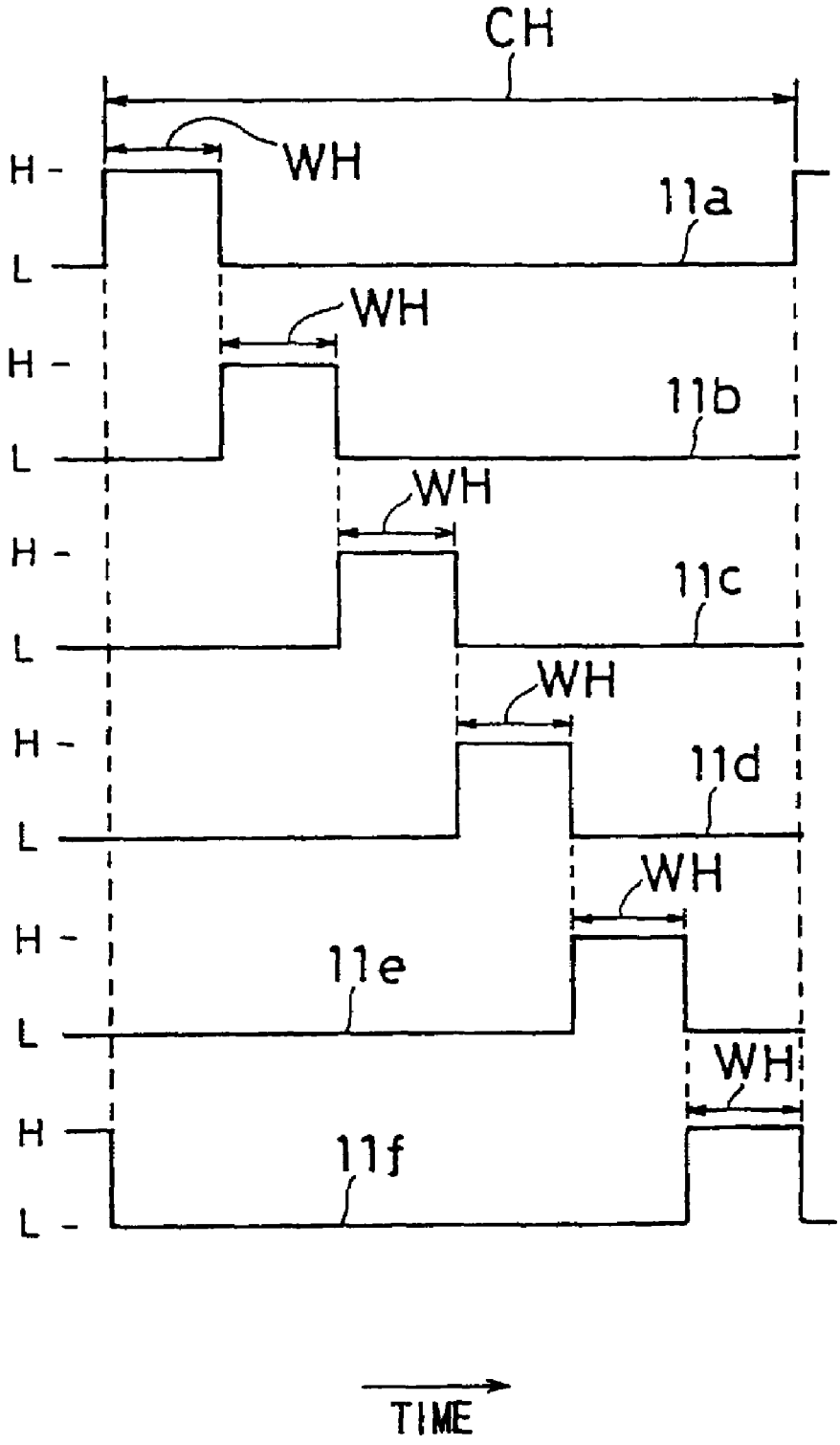
FIG. 11 PRIOR ART
FIG. 11 shows a timing chart of a plurality of scanning signals supplied to a plurality of scanning lines in the liquid crystal panel provided in the liquid crystal display apparatus 1.
Figure 12:
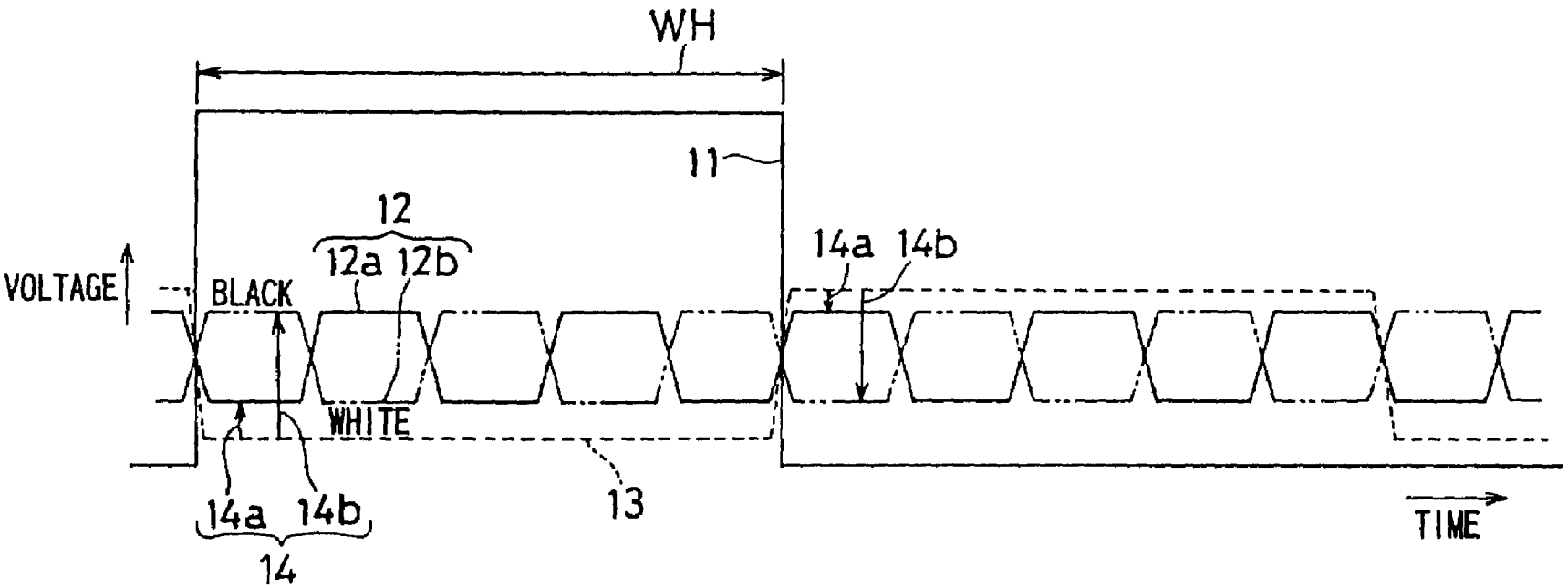
FIG. 12 PRIOR ART
FIG. 12 shows a timing chart of one of the scanning signals, one of a plurality of scanning signals supplied to a plurality of gate lines in the liquid crystal panel, and the voltage applied to the common electrode in the liquid crystal panel when the liquid crystal display apparatus 1 is driven by the use of the line reversal driving method.
Figure 14:
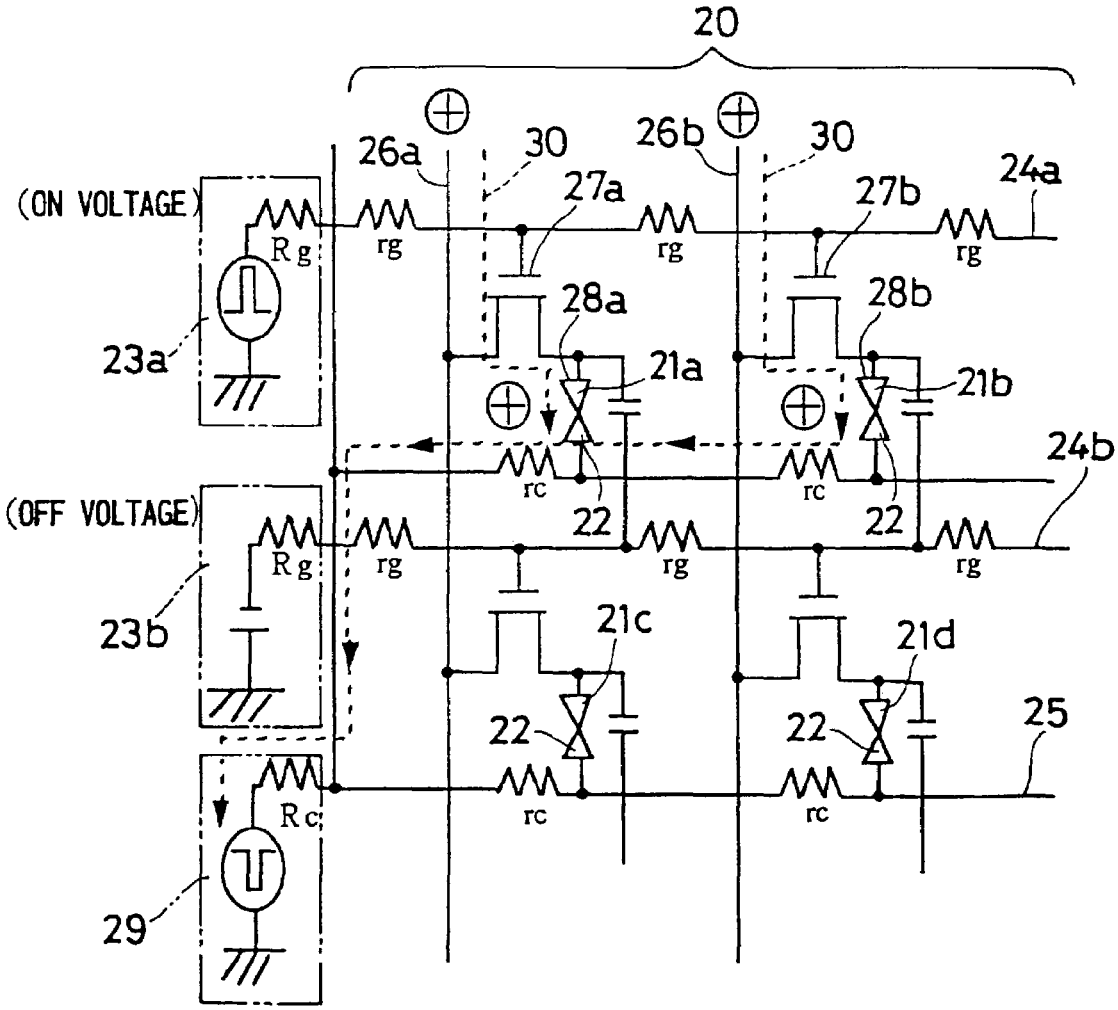
FIG. 14 PRIOR ART
FIG. 14 is a view showing the equivalent circuit of the liquid crystal display apparatus 1.
Figure 15:
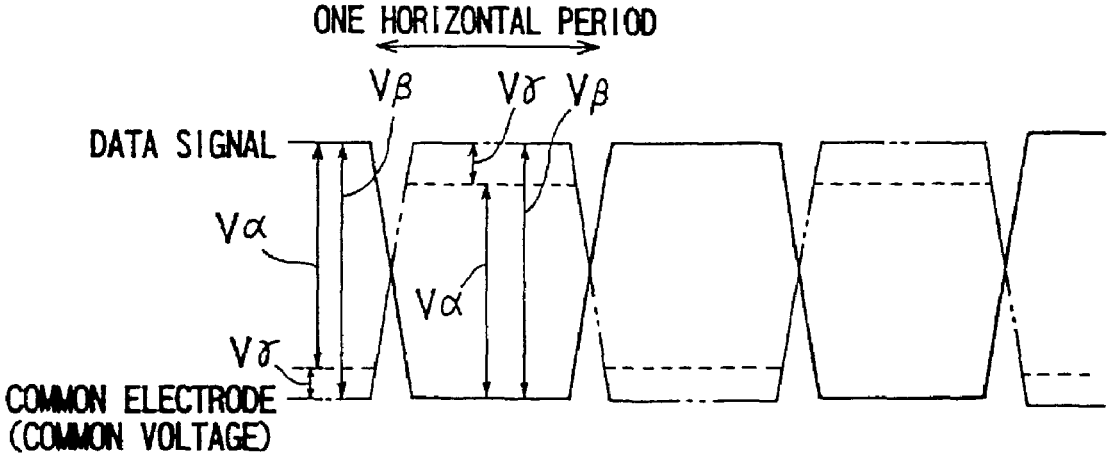
FIG. 15 PRIOR ART
FIG. 15 is a view showing the difference of the voltage to be held by the pixel electrode caused due to the data signal when the liquid crystal display apparatus 1 is driven by the use of the line reversal driving method.
Figure 16:
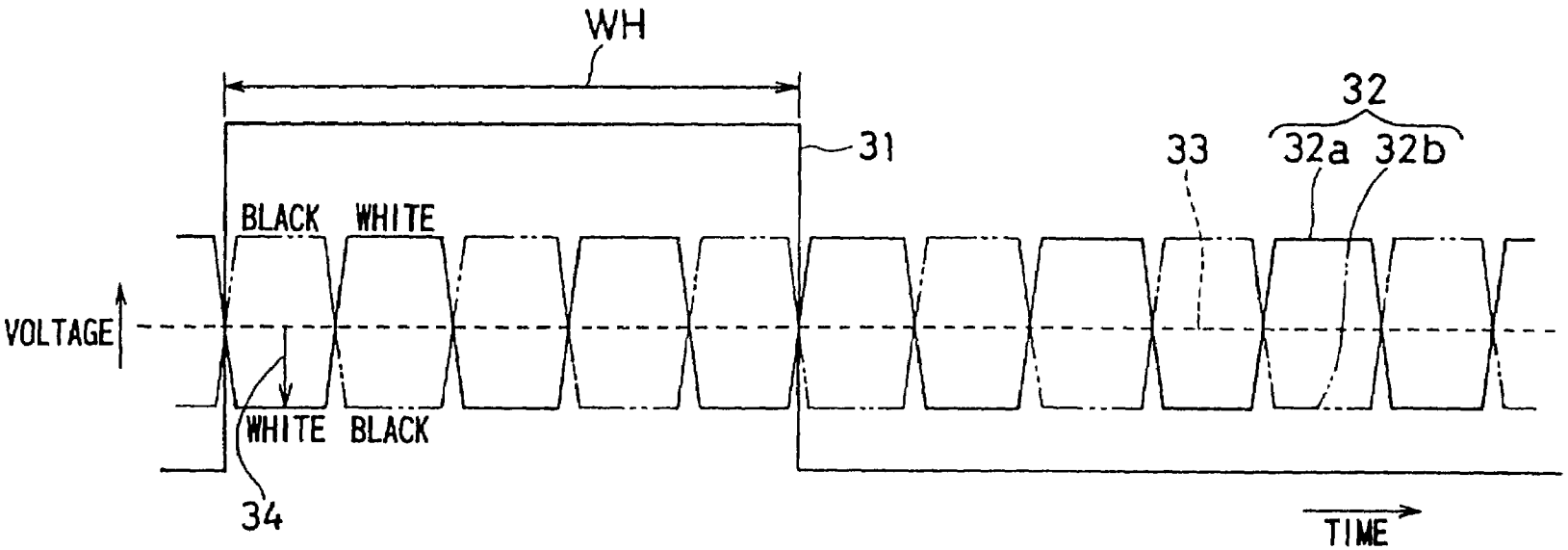
FIG. 16 PRIOR ART
FIG. 16 shows a timing chart of one of the scanning signals, one of a plurality of scanning signals supplied to a plurality of gate lines in the liquid crystal panel, and the voltage applied to the common electrode in the liquid crystal panel when the liquid crystal display apparatus 1 is driven by the use of the dot reversal driving method.

In response to a horizontal synchronizing signal, the gate driver 47 generates scanning signals the number of which is the same as the number of scanning lines 51, and supplies the scanning signals to all the scanning lines 51 of the liquid crystal panel 43. At intervals of the predetermined display period, the scanning signals are held at a level for turning on the TFTs 53, for example, high level during the horizontal period 1H, and are held at a level for turning off the TFT 53, for example, low level during the period other than the horizontal period 1H. The frame display period is, for example, an integral multiple of the horizontal period 1H. Consequently, there is continuity between one of the data lines 52 and the pixel electrode 54 connected to the data line 52 through the TFT 53 only when the TFT 53 is ON. The common electrode is AC-driven at intervals of the horizontal period 1H. The scanning signals and the voltage signals applied to the common electrode 63 are the same as the scanning signals and the voltage signals applied to the common electrode described in the prior art with reference to FIGS. 11 and 12. Consequently, there is continuity between one of the data lines 52 and the pixel electrode 54 connected to the data line 52 through the TFT 53 only when the TFT 53 is ON, and a voltage in accordance with the gradation of the pixel including the pixel electrode 54 is written into the pixel while the TFT 53 is ON. The polarities of the currents flowing through the pixels to write the voltage are as described with reference to FIGS. 13A and 13B.

Consequently, the liquid crystal panel 43 is driven by the use of the so-called line reversal driving method, and voltages in accordance with the gradations of the pixels are written into all the pixels in the liquid crystal panel 43, so that the image represented by the image data supplied from the computer main unit 40 is displayed on the liquid crystal panel 43 as one frame. Thus, the driving portion 42 drives the liquid crystal panel 43 by the use of the so-called line reversal driving method. Therefore, the source and the gate drivers 46 and 47 can be realized by the so-called low withstand process. As a result, the product cost of the liquid crystal display apparatus 41 is lower than the product cost of the conventional liquid crystal display apparatus using the so-called dot reversal driving method.

Figure 4:
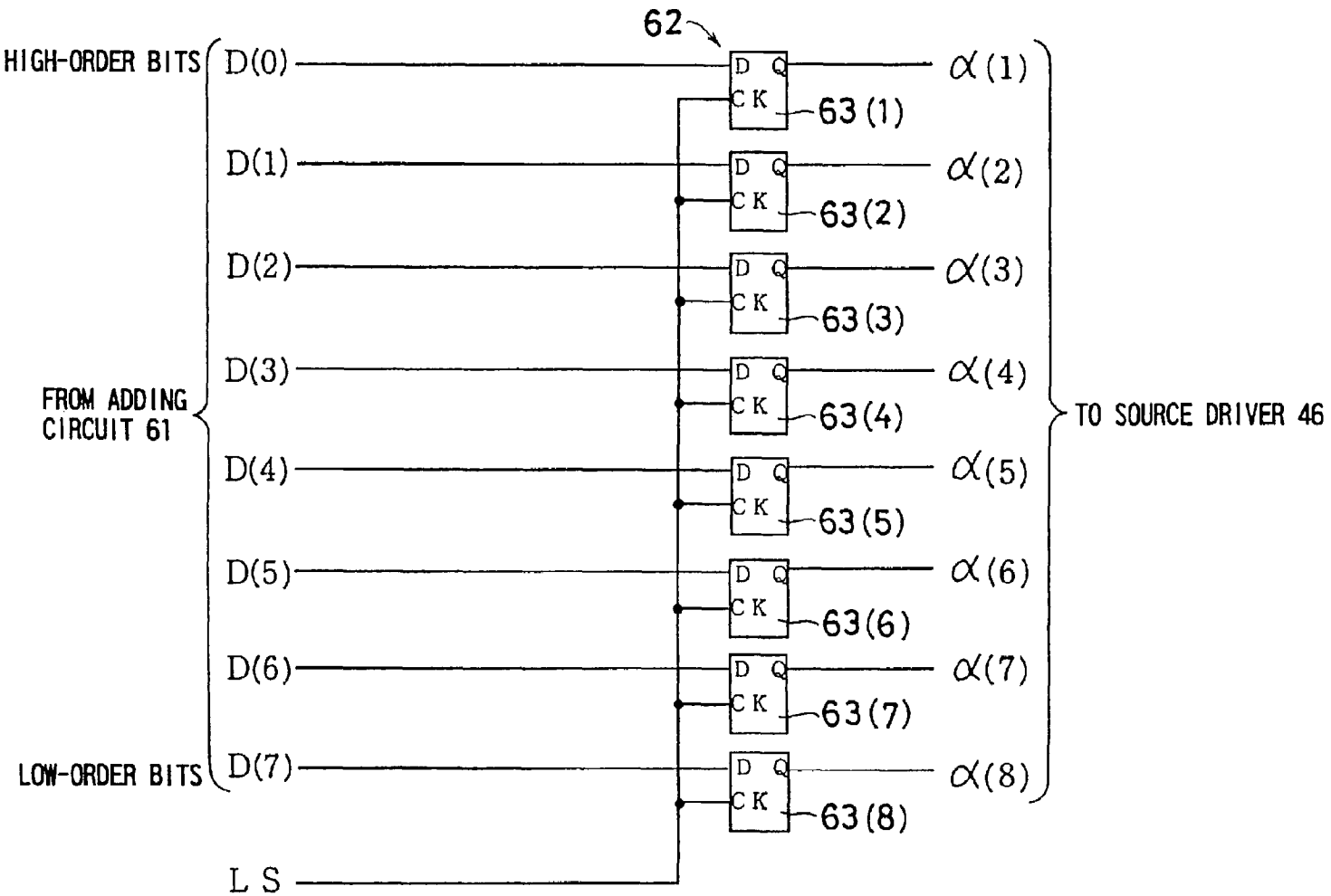
FIG. 4 is a block diagram showing the electric structure of a correction-controlling circuit 62 provided in the liquid crystal display apparatus 41.

FIG. 4 is a block diagram showing the electric stricture of the correction-controlling circuit 62. The correction-controlling circuit 62 includes D flip-flops 63(1) to 63(N) the number of which is the same as the number N of bits constituting the part of the bit string representative of the sum of all the gradation components in the unit portion. In this embodiment, it is assumed that the number N of bits is eight. A given integer not less than 1 and not more than N is represented as "n".

A plurality of bits D(0) to D(N−1) constituting the part of the bit string representative of the sum are supplied to the data input terminals D of the plurality of D flip-flops 63(1) to 63(N), respectively. A latch strobe signal LS from the control circuit 44 is supplied to the clock input terminals CK of all the D flip-flops 63(1) to 63(N). Consequently, the D flip-flops 63(n) latch the bits D(n−1) in response to the latch strobe signal LS, and when the latched bits D(n−1) are "1", the voltages at the output terminals Q of the D flip-flops 63(n) are set at one voltage of predetermined two voltages and when the latched bits D(n−1) are "0", the voltages at the output terminals Q are set at the other voltage of the two voltages. In this embodiment, it is assumed that the one voltage is of high level and the other voltage is of low level.

Consequently, in response to the latch strobe signal LS, the levels of the output terminals Q of the D flip-flops 63(1) to 63(N), that is, the levels of components α(1) to α(N) constituting the correction signal are decided based on the bits D(0) to D(N−1) The components α(1) to α(N) are supplied from the correction-controlling circuit 62 to the source driver 46 in parallel. The correction signal is a set of the components α(1) to α(N). The components α(1) to α(N) are binary signals. The number of components α(1) to α(N) is the same as the number of D flip-flops 63(1) to 63(N), that is, the number N of bits.

Figure 5:
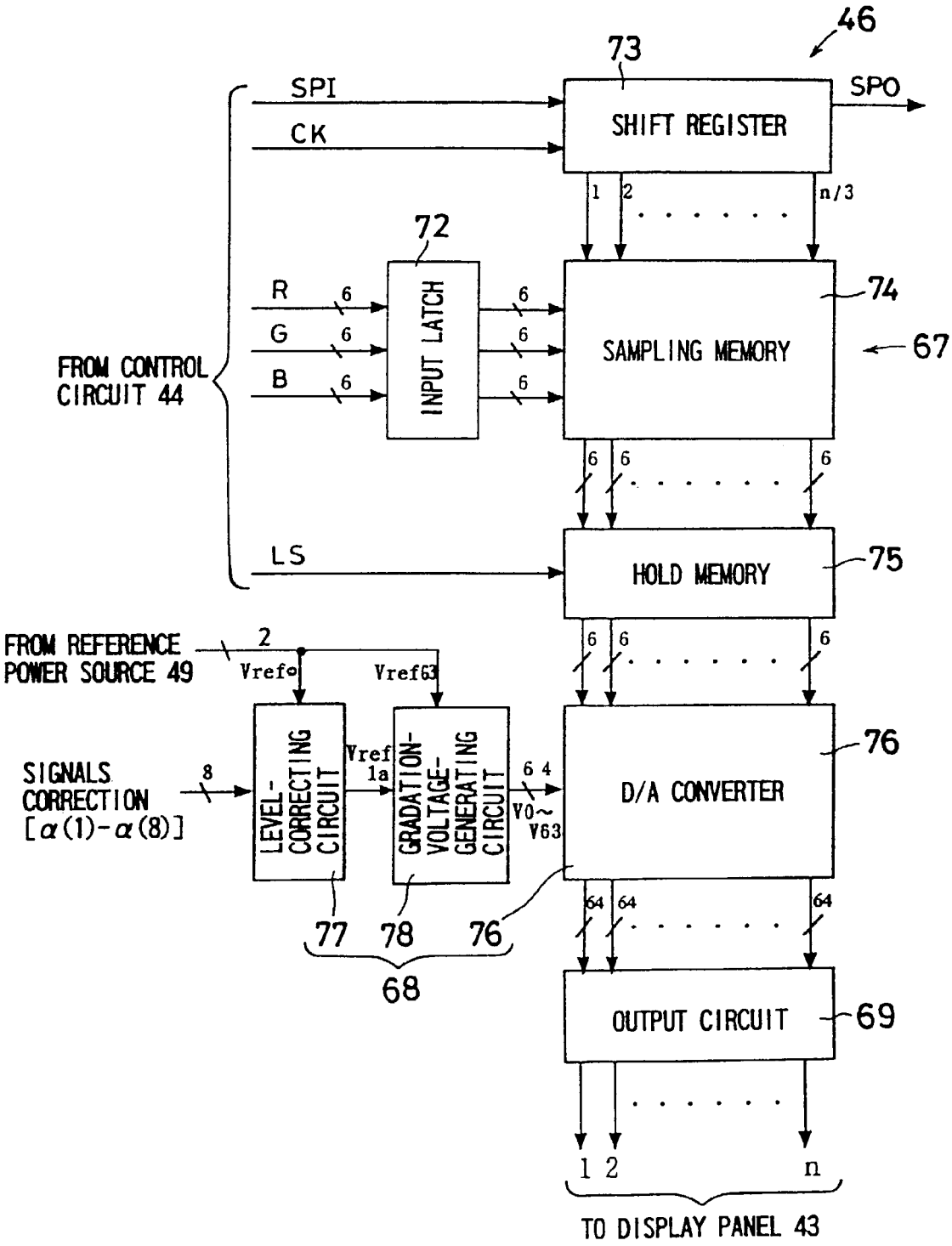
FIG. 5 is a block diagram showing the electric structure of a source driver 46 provided in the liquid crystal display apparatus 41.

FIG. 5 is a block diagram showing the electric structure of the source driver 46. The source driver 46 includes a video signal input portion 67, a voltage setting portion 68 and an output circuit 69. The video signal input portion 67 includes an input latch circuit 72, a shift register 73, a sampling memory 74 and a hold memory 75. The voltage setting portion 68 includes a level-correcting circuit 77, a gradation-voltage-generating circuit 78 and a D/A converter 76. The input latch circuit 72, the shift register 73, the sampling memory 74, the hold memory 75, the D/A converter 76 and the output circuit 29 are the same as the input latch circuit 2, the shift register 3, the sampling memory 4, the hold memory 5, the D/A converter 6 and the output circuit 8 in the source driver 1 of the conventional liquid crystal display apparatus.

The image data in the video signal is supplied to the input latch circuit 72 so that the three pixel components are parallel to one another, and is latched. To the shift register 73, the clock signal CK and an input synchronizing signal SPI for controlling the operation of the video signal input portion 67 are supplied from the control circuit 44. The latch strobe signal LS is supplied to the hold memory 75. The correction signal is supplied to the level-correcting circuit 77. The first reference voltage Vref0 is supplied to the level-correcting circuit 77, whereas the second reference voltage Vref63 is supplied to the gradation-voltage-generating circuit 78. The number of cells in the shift register 73 is, for example, a third of the number of columns of the pixels in the liquid crystal panel 43.

The video signal input portion 67 captures the unit portion from the video signal in response to the latch strobe signal LS. The timing where the video signal input portion 67 captures the unit portion of the video signal is the same as the timing where the adding circuit 61 adds all the gradation components in the unit portion. Therefore, the adding circuit 61 and the video signal input portion 67 capture the same portion of the video signal within the single horizontal period 1H.

Specifically, first, the shift register 73 captures the start pulse SPI in synchronism with the clock signal CK, and the captured start pulse SPI is the sampling timing of the sampling memory 74. Based on the sampling timing supplied from the shift register 73, the sampling memory 74 samples the video signal latched by the input latch circuit 72. Consequently, the unit portion of the video signal is stored in the sampling memory 74. Then, the unit portion of the video signal is transferred from the sampling memory 74 to the hold memory 75 at a time in synchronism with the latch strobe signal LS. The hold memory 75 latches the transferred unit portion in the video signal and transfers the unit portion to the D/A converter 76.

Then, based on the gradation components in the unit portion of the video signal captured by the video signal input portion 67, the voltage setting portion 68 decides the voltages to be held by the data lines 52 in order to decide the gradations of the pixels in one column corresponding to the unit portion in the liquid crystal panel 43. The one column corresponding to the unit portion is, of the all the pixel columns in the liquid crystal panel 43, one column where the gradations of the pixels are decided based on the gradation components in the unit portion.

Specifically, first, the level-correcting circuit 77 corrects the reference voltage Vref0 based on the correction signal. Then, based on the corrected gradation voltage Vref0', the gradation-voltage-generating circuit 78 generates gradation voltages V0' to V63 the number of which is the same as the number of a plurality of gradations that the pixels 58 can take. The plurality of gradation voltages are associated with one of the plurality of gradations that the pixels can take. In this embodiment, it is assumed that 64 levels of gradation voltages V0' to V63 are generated and that the higher the gradation voltages V0' to V63 are, the closer the associated gradations are to the maximum gradation that the pixels can take. Then, based on the gradation components in the unit portion of the video signal transferred from the hold memory 75, the D/A converter 76 selects, as the voltage to be applied to each of the data lines 52, one gradation voltage corresponding to each of the gradations shown by the gradation components from among the 64 levels of gradation voltages V0' to V63. The selected plurality of gradation voltages are transferred from the D/A converter 76 to the output circuit 69.

Thus, the level-correcting circuit 77 corrects the reference voltage Vref0 in accordance with the correction signal, that is, in accordance with the sum of all the gradation voltages in the unit portion. Consequently, the plurality of gradation voltages V0' to V63 correspond to the voltages obtained by correcting in accordance with the correction signal a plurality of voltages corresponding to all the gradations that the pixels can take in the conventional liquid crystal display apparatus. That is, the plurality of gradation voltages V0' to V63 correspond to the voltages obtained by correcting in accordance with the correction signal the 64 levels of voltages obtained by dividing the range from the reference voltage Vref0 to the reference voltage Vref63 into 64 levels. Therefore, the voltages selected by the D/A converter 76, that is, the voltages to be applied to the data lines 52 correspond to the voltages obtained by correcting in accordance with the sum the voltages corresponding to the gradations shown by the gradation components in the conventional liquid crystal display apparatus.

Therefore, only by adding the level-correcting circuit 77 to the conventional voltage setting portion, that is, the voltage generating circuit 78 and the D/A converter 76, the voltage setting portion 68 can correct the voltages corresponding to the gradations shown by the gradation components in the conventional liquid crystal display apparatus in accordance with the sum. Consequently, the voltage setting portion 68 can easily set the voltages to be applied in accordance with the sum.

The output circuit 69 impedance-converts the plurality of gradation voltages selected by the D/A converter, that is, the plurality of voltages to be applied to the data lines 52, thereby generating a plurality of data signals. The data signals are supplied from the output circuit 69 to the data lines 52 of the liquid crystal panel 43 during the horizontal period 1H.

Figure 6:
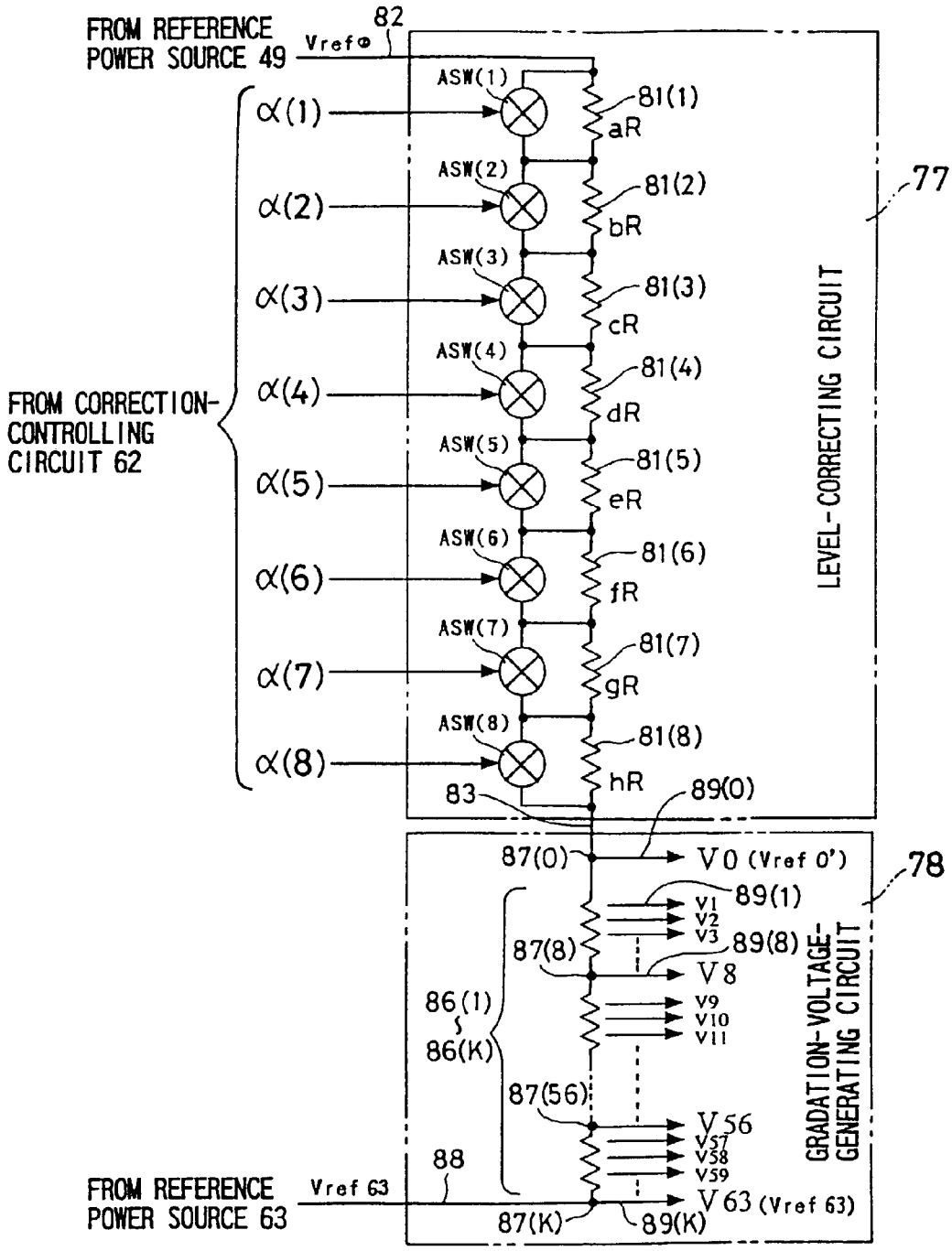
FIG. 6 is a block diagram showing the electric structure of a level-correcting circuit 77 and a gradation-voltage-generating circuit 78 provided in the source driver 46.

FIG. 6 is a block diagram showing the concrete electric structure of the level-correcting circuit 77 and the gradation-voltage-generating circuit 78.

The level-correcting circuit 77 includes correction resistors 81(1) to 81(N) the number of which is the same as the number N of the components α(1) to α(N) of the correction signal, and analog switches ASW(1) to ASW(N) the number of which is the same as the number of correction resistors 81(1) to 81(N). The correction resistors 81(1) to 81(N) are connected in series in this order. The first correction resistor 81(1) has one terminal thereof connected as an input terminal 82 of the level-correcting circuit 77 to the first output terminal of a plurality of terminals of the reference power source 49 for outputting the first reference voltage Vref0, and has the other terminal thereof connected to the second correction resistor 81(2). The last correction resistor 81(N) has one terminal thereof connected to the correction resistor 81(N−1) immediately preceding the last resistor, and has the other terminal thereof connected to a terminal of the gradation-voltage-generating circuit 78 as an output terminal 83 of the level-correcting circuit 77. The analog switches ASW(1) to ASW (N) are connected to the correction resistors 81(1) to 81(N) in parallel. That is, the two terminals of the analog switches ASW(1) to ASW(N) are connected across the correction resistors 81(1) to 81(N).

The analog switches ASW(1) to ASW(N) are opened and closed in response to the levels of the first to the N-th components α(1) to (N) of the correction signal. When the level of a component α(n) is the level of a case in which the bit D(n) of the correction signal is "1", an analog switch ASW(n) corresponding to the component α(n) is closed, and when the level is the level of a case in which the bit D(n) is "0", the analog switch ASW(n) is opened. That is, when the level of the component α(n) is the level of the case in which the bit D(n) is "1", the terminals of a correction resistor 81(n) connected to the analog switch ASW(n) in parallel are short-circuited.

The resistance value of one given correction resistor 81(n) is higher than the sum of the resistance values of all the resistors 81(n+1) to 81(N) that succeed the correction resistor 81(n). Therefore, when the number N of bits is 8, the resistance values aR, bR, cR, dR, eR, fR, gR and hR of the correction resistors 81(1) to 81(8) satisfy the relationships of expressions (2) to (8) shown below. "R" is a predetermined resistance value. Coefficients "a" to "h" are decided based on at least one of the resistance value and the capacity value of the data line 52.

$$gR>hR \tag{2}$$

$$fR>gR+hR \tag{3}$$

$$eR>fR+gR+hR \tag{4}$$

$$dR>eR+fR+gR+hR \tag{5}$$

$$cR>dR+eR+fR+gR+hR \tag{6}$$

$$bR>cR+dR+eR+fR+gR+hR \tag{7}$$

$$aR>bR+cR+dR+eR+fR+gR+hR \tag{8}$$

The overall resistance value of the level-correcting circuit 77 depends on the combination of opening and closing of the analog switches ASW(1) to ASW(N). The combination of opening and closing corresponds to the combination of the levels of the components α(1) to α(N), that is, the part of the bit string representative of the sum of all the gradation components in the unit portion. When the resistance values of the correction resistors 81(1) to 81(N) satisfy the relationships of the expressions, the higher the digit, in the part of the bit string, of the bit for deciding the level of the component α(n) supplied to the analog switch ASW(n) connected to the correction resistor 81(n) in parallel is, the higher the resistance value of the resistor 81(n) is. Therefore, the higher the numerical value represented by the part of the bit string is, the higher the overall resistance value of the level-correcting circuit 77 is. Consequently, the higher the numerical value represented by the part of the bit string is, that is, the larger the sum is, the smaller the drop amount of the first reference voltage Vref0 is.

The gradation-voltage-generating circuit 78 includes, for example, voltage dividing resistors 86(1) to 86(K) the number of which is smaller by one than the number of the gradation voltages. The voltage dividing resistors 86(1) to 86(K) are all connected in series in this order. The first voltage driving resistor 86(1) has one terminal thereof connected to the output terminal 83 of the level-correcting circuit 77 as a first input terminal of the gradation-voltage-generating circuit 78, and has the other terminal thereof connected to the second voltage dividing resistor 86(2). The last voltage dividing resistor 86(K) has one terminal thereof connected to the voltage dividing resistor 86(K−1) immediately preceding the last resistor, and has the other terminal thereof connected to a second output terminal of a plurality of terminals of the reference power source 49 for outputting the second reference voltage Vref63. To a connection point 87(0) between the one terminal of the first voltage dividing resistor 86(1) and the output terminal 83 of the level-correcting circuit 77, to connection points 87(1) to 87 (K−1) between the voltage dividing resistors 86(1) to 86(K) and to a connection point 87(K) between the last voltage dividing resistor 86(K) and the second output terminal of the reference power source 49, voltage obtaining conductors 89(0) to 89(K) for obtaining the voltages at the contact points 87(0) to 87(K) as the gradation voltages V0' and V63 are connected.

Therefore, the gradation-voltage-generating circuit 78 divides the difference between the second reference voltage Vref63 and the voltage level of the output terminal 83 of the level-correcting circuit 77, that is, the corrected first reference voltage Vref0' into the number the same as the number of gradations that the pixels can take. In this embodiment, the first gradation voltage V0' of the 64 levels of gradation voltages V0' to V63 equals the corrected first reference voltage Vref0', whereas the last gradation voltage V63 of the 64 levels of gradation voltages V0' to V63 equals the second reference voltage Vref63.

The gradation-voltage-generating circuit 78 is not limited to the above-described structure but may have a different structure as long as the range from the corrected first reference voltage Vref0' to the second reference voltage Vref63 can be divided into the number the same as the number of gradations that the pixels can take. For example, a structure may be used in which first resistors the number of which is smaller than the number of gradation voltages are interposed between the output terminal 83 of the level-correcting circuit 77 and the second output terminal of the reference power source 49, a plurality of second resistors connected in series are connected across the resistors in parallel, and the voltage difference ΔVref divided into a plurality of numbers by the first resistors is further divided by the second resistors.

Thus, the basic structure of the level-correcting circuit 77 comprises resistors and analog switches, and the basic structure of the gradation-voltage-generating circuit 78 comprises resistors. Consequently, the basic structures of the level-correcting circuit 77 and the gradation-voltage-generating circuit 78 are extremely simple. As a result, the circuit scale of the voltage setting portion 68 is prevented from increasing, and increase in the manufacturing cost of the liquid crystal display apparatus 41 is curbed.

It is preferable that at least the level-correcting circuit 77 and the gradation-voltage-generating circuit 78 be formed within a single integrated circuit. This is because variations in characteristics of the parts in the voltage setting portion 68 due to the manufacturing process of the integrated circuit are curbed more when the level-correcting circuit 77 and the gradation-voltage-generating circuit 78 are formed in one integrated circuit than when the level-correcting circuit 77 and the gradation-voltage-generating circuit 78 are formed in two different integrated circuits. The characteristics of the parts are, for example, the resistance values of the resistors. Moreover, since the number of integrated circuits in the liquid crystal display apparatus 41 is smaller when the circuits 77 and 78 are formed in one integrated circuit than when the circuits 77 and 78 are formed in two integrated circuits, the part cost of the liquid crystal display apparatus 41 is reduced and the assembly of the liquid crystal display apparatus 41 is facilitated. In the liquid crystal display apparatus 41 of this embodiment, the level-correcting circuit 77 and the gradation-voltage-generating circuit 78 together with the other parts 72 to 76 and 68 of the source driver constitute one integrated circuit.

Of the liquid crystal panel driving methods of the driving portion 42, the behavior for causing the data lines 52 to hold voltages in accordance with the gradations of the pixels will hereinafter be described with reference to FIGS. 1 to 6. In parallel with the behavior, the gate driver 47 controls the TFTs 53 through the gate lines and the common electrode 63 is AC-driven. The behaviors of the gate driver 47 and the common electrode 63 are the same as the behaviors of the gate driver and the common electrode of the conventional liquid crystal display apparatus.

For example, as a first example, a case is assumed in which the part of the video signal sampled by the sampling memory 76, that is, all the gradation components in the unit portion of the video signal represent the maximum gradation that the pixels can take. In this case, the voltages between the pairs of electrodes 54 and 59 in all the pixels in the column corresponding to the unit portion in the liquid crystal panel 43 are the highest of the voltages that can be held between the pair of electrodes 54 and 59. In this case, the result of addition by the adding circuit 61, that is, the bit string representative of the sum of all the gradation components is "11111010000000000".

In response to the latch strobe signal LS, the correction-controlling circuit 62 captures the highest order eight bits of the addition result, that is, "11111010" and decides the levels of the components α(1) to α(N) of the correction signal. In the first example, the first to the fifth and the seventh components α1 to α5 and α7 are of high level, whereas the sixth and the eighth components α6 and α8 are of low level. Consequently, the first to the fifth and the seventh analog switches ASW1 to ASW5 and ASW7 are closed and the sixth and the eighth analog switches ASW 6 and ASW8 are opened. Therefore, the equivalent circuit of the level-correcting circuit 77 is a circuit in which the sixth and the eighth correction resistors R6 and R8 are connected in series.

As a second example, a case is assumed in which all the gradation components in the unit portion of the video signal show the minimum gradation that the pixels can take. In this case, the bit string representative of the sum of all the gradation components is "00000000000000000". In response to the latch strobe signal LS, the correction-controlling circuit 62 captures the highest order eight bits of the addition result, that is, "00000000" and decides the levels of the components α(1) to α(N) of the correction signal. In the second embodiment, since the captured bits are all 0, the levels of the components α1 to α8 are all low. Consequently, the analog switches ASW1 to ASW8 are all opened. Therefore, the equivalent circuit of the level-correcting circuit 77 is a circuit in which the correction resistors R1 to R8 are all connected in series.

Comparing the first example and the second example, the sum of the resistance values of the resistors interposed between the first output terminal of the reference power source 49 and the gradation-voltage-generating circuit 78, that is, the overall resistance value of the level-correcting circuit 77 in the second example is higher than the overall resistance value of the level-correcting circuit 77 in the first example. Therefore, the drop amount of the first reference voltage Vrefϕ in the second example is larger than the drop amount of the first reference voltage Vrefϕ in the first example. From the above, the greater the number of maximum gradations included in the gradations shown by all the gradation components in the unit portion is, the more the level-correcting circuit 77 decreases the drop amount of the first reference voltage Vref0. That is, the closer the voltages between the pair of electrodes in the pixels in the column corresponding to the unit portion in the liquid crystal panel 43 are to the maximum voltage that can be held between the pair of electrodes 54 and 59, the smaller the corrected reference voltage difference is. This is for the following reason:

In the liquid crystal panel 43 driven by the line reversal driving method, the voltage held by the common electrode 56 drops due to the voltages of all the data signals supplied to the liquid crystal panel 43 during one horizontal period. Therefore, due to the voltage drop, the voltage actually held by the common electrode 56 is closer to the voltages of the data signals than to the ideal voltage to be held by the common electrode 56. The smaller the voltages of all the data signals are, the larger the difference between the voltage actually held by the common electrode 56 and the ideal voltage is. The closer the voltage between the pair of electrodes 54 and 59 in the pixel 58 to which the voltage corresponding to the gradation is written by a single data signal is to the maximum voltage of the plurality of levels of voltages that can be held between the pair of electrodes 54 and 59, the lower the voltage of the data signal is. In this embodiment, the closer the gradation of the pixel is to the maximum gradation, the closer the voltage held between the pair of electrodes 54 and 59 of the pixel 58 is to the maximum voltage. Therefore, the greater the number of maximum gradations included in the gradations shown by all the gradation components in the unit portion is, the larger the difference is.

Consequently, the greater the number of data signals, among all the data signals, the voltages of which are the maximum voltage is, the more the drop amount of the first reference voltage Vref0 is reduced, and the greater the number of data signals, among all the data signals, the voltages of which are the minimum voltage is, the drop amount of the first reference voltage Vref0 is increased. That is, in this embodiment, the greater the number of maximum gradations included in the gradations shown by all the gradation components in the unit portion is, the more the drop amount of the first reference voltage Vref0 is curbed. Consequently, the greater the number of data signals, among all the data signals, the voltages of which are the maximum voltage is, the lower the corrected first reference voltage Vref0' is. When the gradation voltages V0' to V63 are generated by the use of the first reference voltage Vref0' thus corrected, the gradation voltages V0' to V63 are the same as the voltages obtained by correcting in accordance with the magnitude of the difference the voltage obtained by dividing the range between the two reference voltages Vref0 and Vref63 into 64 levels. That is, the voltages of the data signals are corrected in accordance with the magnitude of the difference.

Consequently, the nonuniformity in brightness among a plurality of columns in the image displayed on the liquid crystal panel 43 is eliminated and the quality of the image displayed on the liquid crystal panel 43 is prevented from being degraded due to the generation of so-called shadowing. From these, in the liquid crystal display apparatus 41 of this embodiment, the liquid crystal panel 43 can be made better in display quality than the conventional liquid crystal display apparatus using the line reversal driving method, and the driving portion 42 can be made in lower cost than the structure for driving the liquid crystal panel of the conventional liquid crystal display apparatus using the dot reversal driving method. In addition, in the liquid crystal display apparatus 41 of this embodiment, the display quality reduction due to increase in the size of the liquid crystal panel 43 can be prevented and the display quality reduction due to increase in the number of pixels in the liquid crystal panel 43 can be prevented.

The first reference voltage Vref0 may be corrected based on a numerical value other than the sum of the gradations shown by all the gradation components in the unit portion of the video signal as long as it is a numerical value representing how close the voltages between the pair of electrodes 54 and 59 in the pixels 58 in the column corresponding to the unit portion of the video signal are to the maximum voltage that can be held between the pair of electrodes 54 and 59. For example, the numerical value other than the sum may be the result of a division in which the sum of the gradations is divided by a predetermined constant, or may be the average of the gradations shown by all the gradation components in the unit portion. When the sum is used for the correction of the first reference voltage Vref0, the computing portion for obtaining the numerical value, that is, the adding circuit 61 can be realized by a typical adding circuit. Therefore, it is preferable to use the sum for the correction of the first reference voltage Vref0 because the structure of the computing portion is simplified and the computing operation for obtaining the numerical value is facilitated.

The correction-controlling circuit 62 of the liquid crystal display apparatus 41 of this embodiment generates the correction signal by the use of only the highest eight digits of the bit string representative of the result of the computing operation by the adding circuit 61. The part of the bit string used for the generation of the correction signal is not limited to the highest eight digits but may be a different part. The number of bits of the part is not limited to eight but may be a different number. Which part of the bit string is used for the generation of the correction signal is decided, for example, according to display characteristics of the liquid crystal panel 63. For example, of the bit string, the eight odd-numbered bits counted from the first bit may be set as the part. Moreover, for example, of the bit string, the eight even-numbered bits counted from the first bit may be set as the part.

Thus, when only a part of the bit string is used for the generation of the correction signal, the number of components of the correction signal is smaller than the number of bits of the bit string. Therefore, the number of input terminals of the source driver 46 for inputting the correction signal can be made smaller than the number of input terminals for inputting the bit string when the bit string is directly supplied to the source driver 46, and the circuit scale of the driving portion 42 when the correction signal is supplied to the source driver 46 can be made smaller than the circuit scale of the driving portion when the bit string is directly supplied to the source driver 46. When the first reference voltage Vref0 is corrected by the use of only a part of the bit string, the closer the number of bits of the part is to the number of all the bits of the bit string, the higher the correction accuracy of the corrected first reference voltage Vref0' is.

Figure 7:
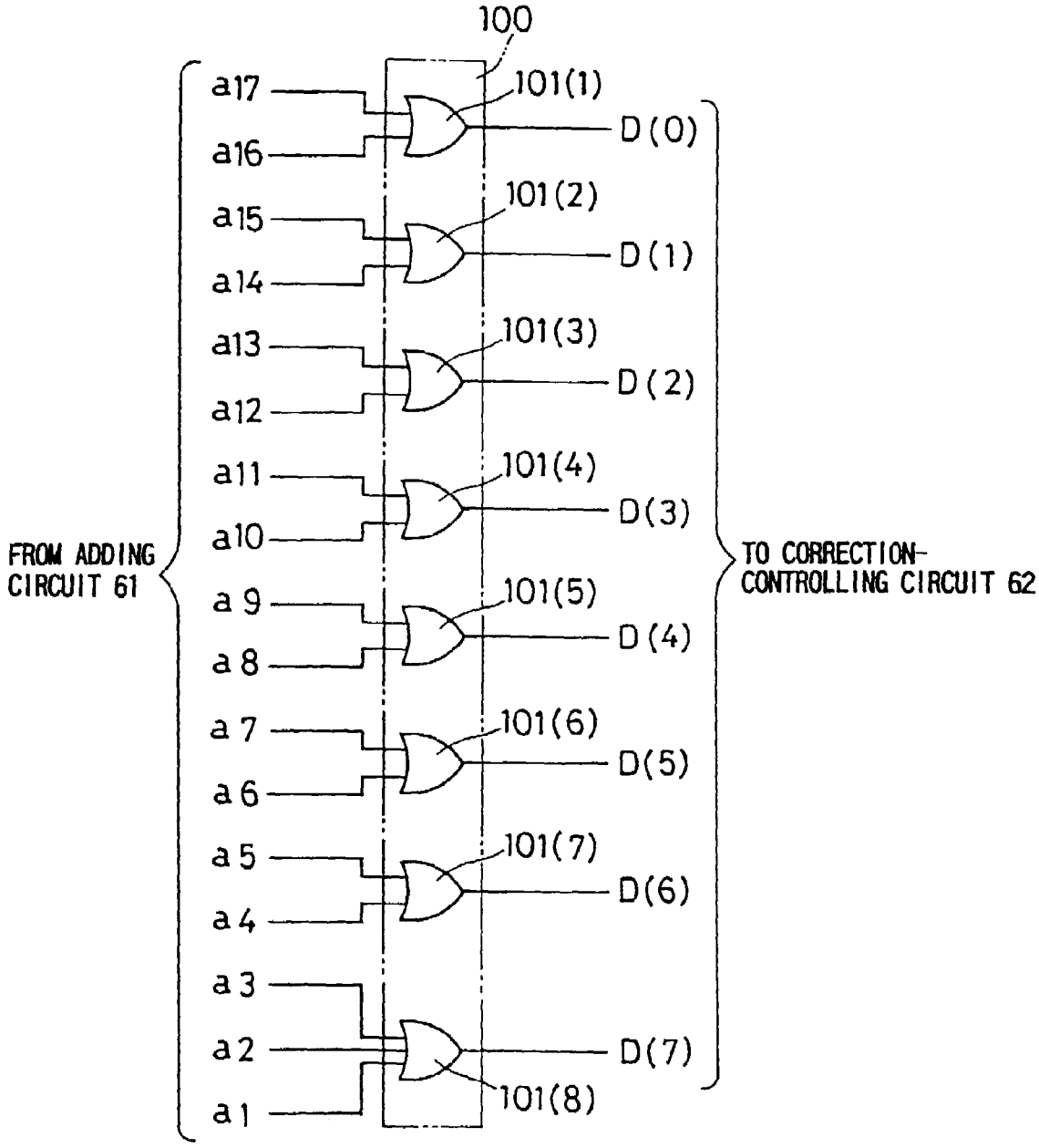
FIG. 7 is a block diagram showing the electric structure of a bit computing circuit 100 provided in the liquid crystal display apparatus 41.

Further, the correction-controlling circuit 62 may produce a bit string including fewer bits than the bit string representative of the sum by performing a predetermined computing operation on all the bits of the bit string representative of the sum obtained by the adding circuit 61 and generate the correction signal by the use of the produced bit string. To do so, for example, a bit computing circuit 100 shown in FIG. 7 is interposed between the adding circuit 61 and the correction-controlling circuit 62. The bit computing circuit 100 includes OR circuits 101(1) to 101(J) the number J of which is smaller than the number of bits of the bit string representative of the sum. The OR circuits 101(1) to 101(J) are all arranged in parallel. In FIG. 7, it is assumed that the number J of OR circuits is eight.

To the OR circuits 101(1) to 101(J), a plurality of continuous bits in the bit string representative of the sum are inputted to obtain the logical product of the plurality of bits. For example, in the example of FIG. 7, to the first OR circuit 101(1), the seventeenth and the sixteenth bits a17 and 16 counted from the first bit of the bit string representative of the sum are inputted. To the second OR circuit 101(2), the fifteenth and the fourteenth bits a15 and 14 counted from the first bit of the bit string representative of the sum are inputted. To the seventh OR circuit 101(7), the fifth and the fourth bits a5 and a4 counted from the first bits of the bit string representative of the sum are inputted. To the eighth OR circuit 101(8), the third to the first bits a3 to a1 counted from the first bit of the bit string representative of the sum are inputted.

Consequently, a number, J, of logical products are obtained. In the example of FIG. 7, the following logical products are obtained: the logical product of the seventeenth and the sixteenth bits a17 and a16; the logical product of the fifteenth and the fourteenth bits a15 and 14; . . . ; the logical product of the fifth and the fourth bits a5 and a4; and the logical product of the third to the first bits a3 to a1. Instead of the bits of the part of the bit string representative of the sum, the number, J, of the logical products are inputted to the data input terminals D of the D flip-flops 63(1) to (N) of the correction-controlling circuit 62. In this case, the number, J, of the logical products and the number, N, of the D flip-flop are the same.

In the liquid crystal display apparatus 41 of this embodiment, the correction signal is supplied to the source driver 46*n* as it is. In this case, since the eight components of the correction signal is supplied to the source driver 46 in parallel, the source driver of this embodiment has eight more input terminals than the source driver of the conventional liquid crystal display apparatus. In order to reduce the number of input terminals for inputting the correction signal, a so-called 8 to 3 decode circuit and a so-called 3 to 8 decode circuit may be interposed between the correction-controlling circuit 61 and the source driver 46 and between the input terminal and the level-correcting circuit 77 in the source driver 46, respectively.

Consequently, first, the correction signal is supplied to the source driver 46 after the eight components are converted into three sets of electric signals by the 8 to 3 decode circuit. Then, the three sets of electric signals are supplied to the level-correcting circuit 77 after decoded into the eight components by the 3 to 8 decode circuit. Therefore, the number of input terminals of the source driver 46 for inputting the correction signal can be reduced from eight to three. The two circuits for performing the conversion and the decoding are not limited to the 8 to 3 decode circuit and the 3 to 8 decode circuit but may be different circuits as long as the circuits are a converting circuit for converting the eight components into less than eight electric signals and a reconstituting circuit capable of reconstituting the eight components from the electric signals without any error.

Figure 8:
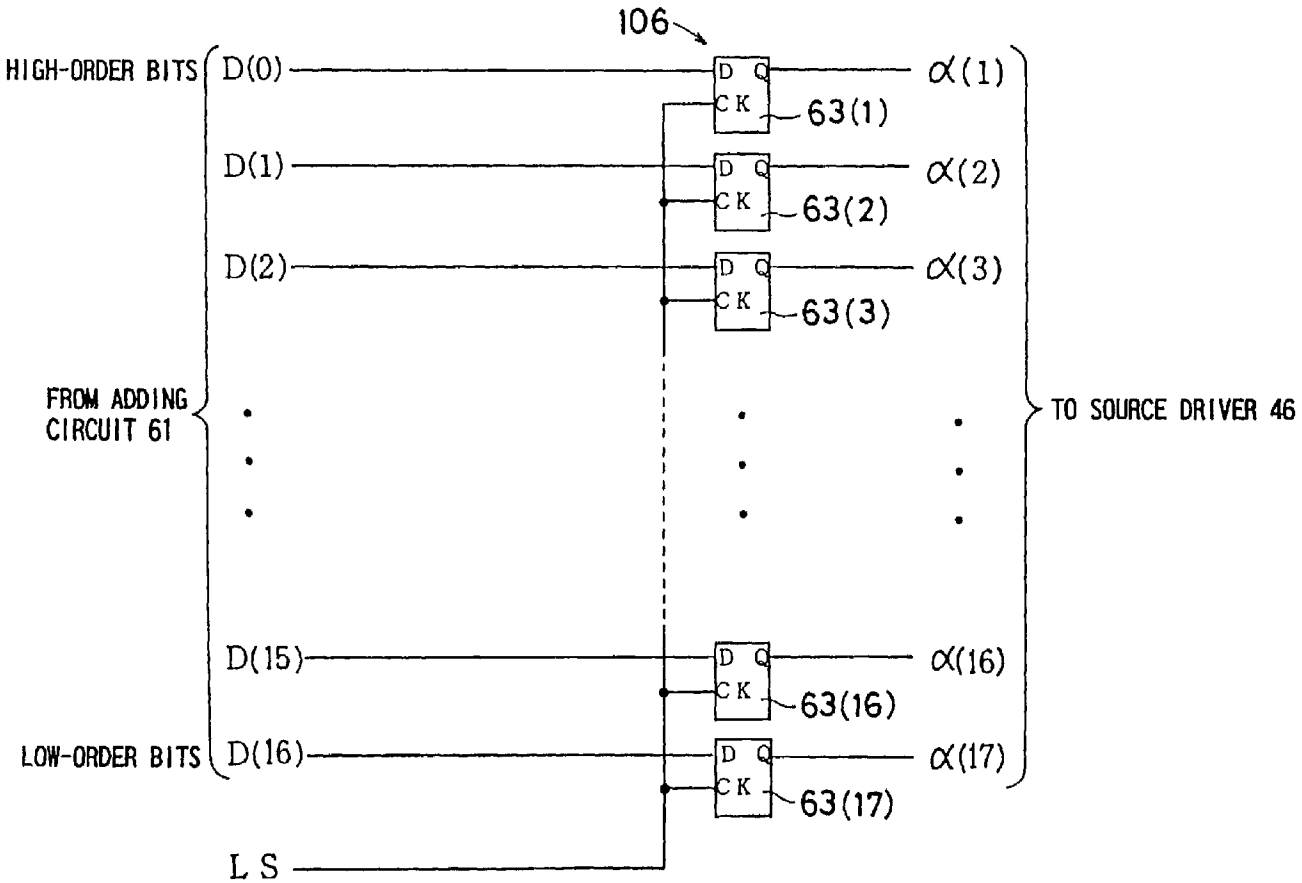
FIG. 8 is a block diagram showing the electric structure of a correction-controlling circuit 106 provided in the liquid crystal display apparatus 41.
Figure 9:
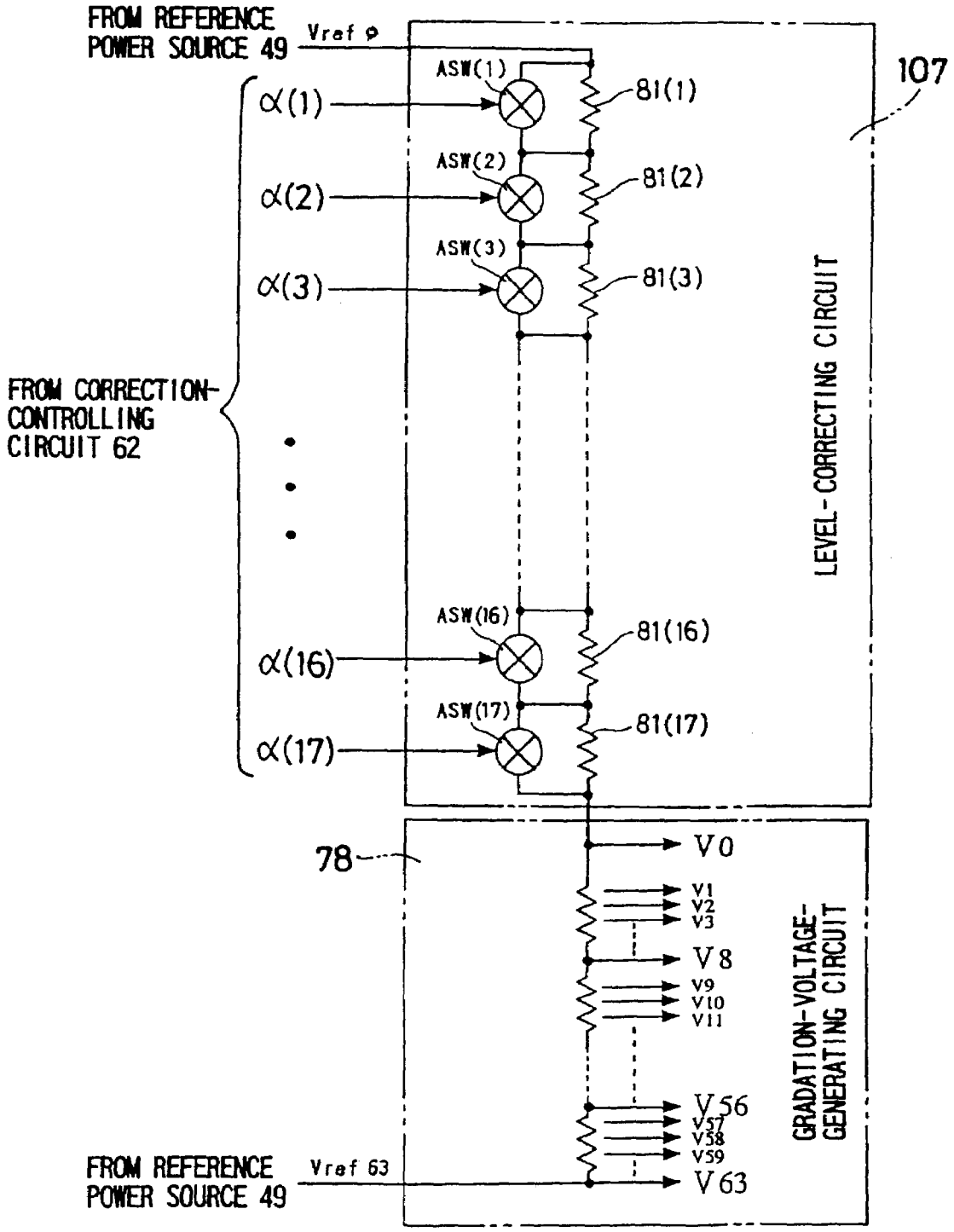
FIG. 9 is a block diagram showing the electric structure of a level-correcting circuit 107 and the gradation-voltage-generating circuit 78 provided in the source driver 46.
Figure 10:
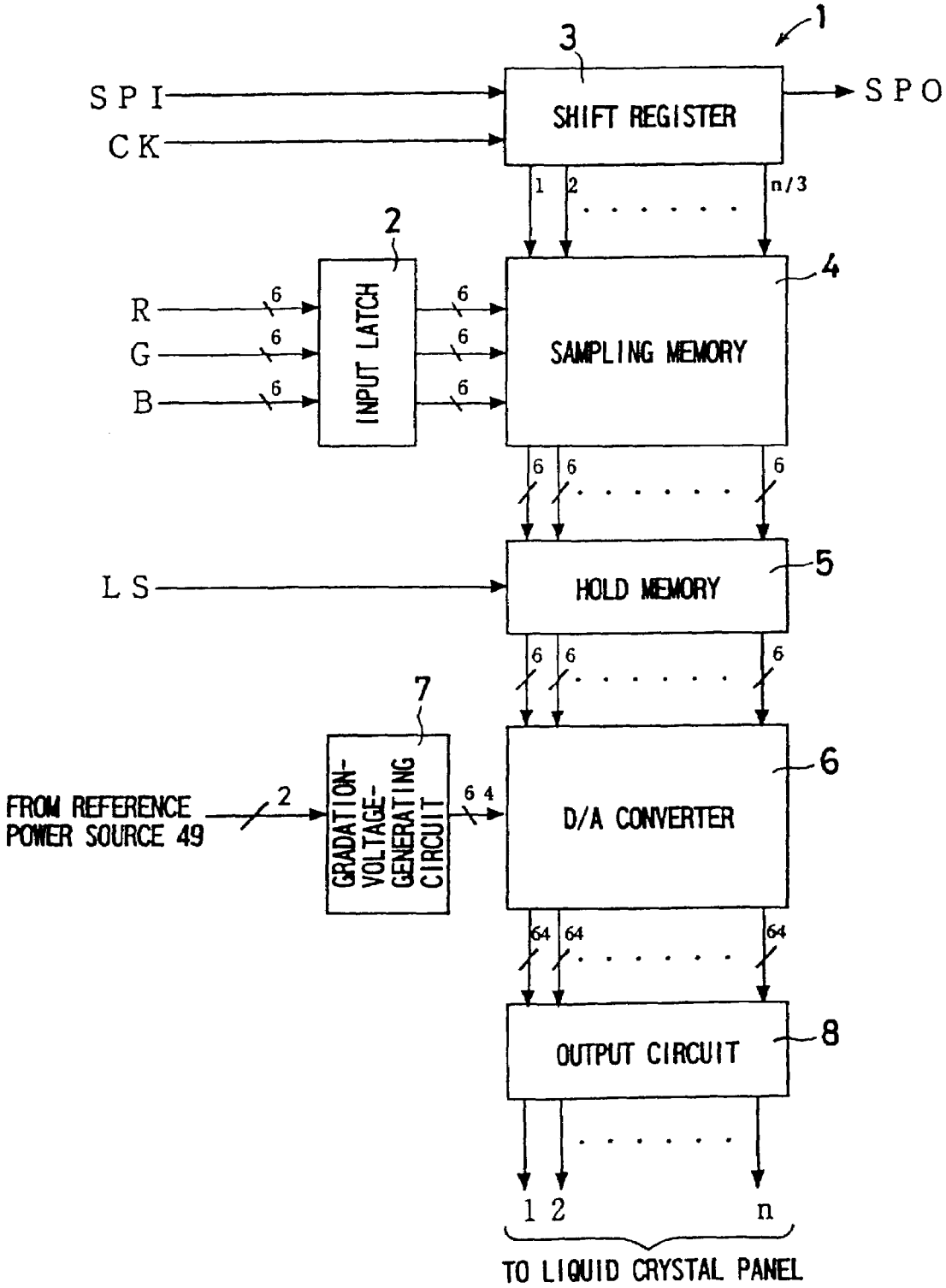
FIG. 10 PRIOR ART
FIG. 10 is a block diagram showing the electric structure of the source driver 1 provided in the conventional liquid crystal display apparatus.

The correction-controlling circuit 62 may generate the correction signal by the use of all the bits of the bit string representative of the sum obtained by the adding circuit 61. To do so, the correction-controlling circuit 62 and the level-correcting circuit 77 are replaced by a correction-controlling circuit 106 of FIG. 8 and a level-correcting circuit 107 of FIG. 9. The correction-controlling circuit 106 of FIG. 8 is the same as the correction-controlling circuit 62 of FIG. 4 except that the number N of D flip-flops 63(1) to 63(N) is the same as the number M of all the bits of the bit string and that the bits to be processed are changed from the bits constituting a part of the bit string to all the bits of the bit string. In this embodiment, it is assumed that the number M of all the bits is 17. Therefore, the correction signal comprises the components $\alpha$(1) to $\alpha$(M) the number of which is the same as the number M of all the bits, and the components $\alpha$(1) to $\alpha$(M) are supplied to the source driver 46 in parallel. The level-correcting circuit 107 of FIG. 9 is the same as the level-correcting circuit 77 of FIG. 6 except that the number of the correction resistors 81(1) to 81(N) and the number of analog switches ASW(1) to ASW (N) are the same as the number of components $\alpha$(1) to $\alpha$(M) of the correction signal, that is, the number M of all the bits.

Like the level-correcting circuit 77 of FIG. 6, the resistance value of one correction resistor 18(m) of the seventeen correction resistors 81(1) to 81(M) in the level-correcting circuit 107 is higher than the sum of the resistance values of all the resistors 81(m+1) to 81(M) that succeed the one resistor 81(*i*). "m" is an integer not less than 1 and not more than M. That is, the resistance values aR, bR, cR, dR, eR, fR, gR, hR, iR, jR, kR, lR, mR, nR, oR, pR and qR of the correction resistors 81(1) to 81(17) satisfy the relationships of the following expressions (9) to (15):

$$pR>qR \tag{9}$$

$$oR>pR+qR \tag{10}$$

$$nR>oR+pR+qR \tag{11}$$

$$mR>nR+oR+pR+qR \tag{12}$$

$$lR>mR+nR+oR+pR+qR \tag{13}$$

$$kR>lR+mR+nR+oR+pR+qR \tag{14}$$

$$\vdots$$

$$aR>bR+cR+dR+eR+fR+gR+hR+iR+jR+kR+lR+mR+nR+oR+pR+qR \tag{15}$$

Thus, the liquid crystal display apparatus to which the bit string computing circuit 100 of FIG. 7 is added and the liquid crystal display apparatus using the correction-controlling circuit and the level-correcting circuit of FIGS. 8 and 9 are capable of correcting the first reference voltage Vref0 for the correction of the gradation voltages by the use of all the bits of the bit string representative of the sum. Consequently, the correction accuracy of the plurality of gradation voltages is the highest. As a result, a best-display-quality liquid crystal display apparatus can be attained.

The relationship between the voltages of the data signals and the gradations of the pixels 58 may be opposite to that of the description given above. That is, the gradations of the pixels 58 into which the voltages corresponding to the gradations are written by the data signals may be closer to the minimum gradation as the voltages of the data signals become closer to the maximum voltage that the pixels 58 can take. In this case, the greater the number of minimum gradations included in the gradations shown by all the gradation components in the unit portion is, that is, the greater the number of data signals, among the plurality of data signals decided by the gradation components in the unit portion, the voltages of which are the maximum voltage is, the more the drop amount of the first reference voltage Vref0 is necessarily reduced. Therefore, by decreasing the overall resistance value of the level-correcting circuit 77 as the sum of the numerical values corresponding to the gradations shown by all the gradation components in the unit portion decreases, the difference of the voltage of the common electrode 56 can be corrected. That is, the pixels voltages V0' to V63 are made closer to the first reference voltage Vref0 as the sum of the voltages of all the data signals decided by the plurality of gradation components in the unit portion increases.

The liquid crystal display apparatus 41 of this embodiment is an example of the liquid crystal display apparatus of the invention and the method of driving a liquid crystal panel of the invention and can be practiced in various other forms as long as the principal operations are the same. Particularly, the detailed operations of the parts in the liquid crystal display apparatus 41 are not limited to the ones shown above but may be realized by different operations as long as the same processing results are obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of driving a liquid crystal panel including a plurality of pixels arranged in a matrix form, the plurality of pixels each including a pair of electrodes and liquid crystal sandwiched therebetween, and being divided into a plurality of pixel groups each composed of plural pixels, the method comprising:

performing a predetermined computing operation at intervals of a predetermined horizontal period by adding all gradation display data representative of gradations of pixels of one of the pixel groups;

correcting a voltage determined from gradation data of each pixel of the one pixel group, on the basis of a result of the computing operation, to obtain a corrected voltage; and applying the corrected voltage between a pair of electrodes of each pixel of the one of the pixel groups during the predetermined horizontal period in order to reduce non-uniformity of a display.

2. A liquid crystal display apparatus comprising:

a liquid crystal panel including a plurality of pixels arranged in a matrix form, the plurality of pixels including a pair of electrodes and liquid crystal sandwiched therebetween, and being divided into a plurality of pixel groups each including a plurality of pixels, computing means including an adding circuit which performs a computing operation by adding gradation representative of gradations of pixels of one of the pixel groups at intervals of a predetermined horizontal period;

correction voltage setting means for correcting a voltage determined from gradation data of each pixel of the one pixel group, on the basis of a result of the computing operation, to obtain a corrected voltage;

voltage applying means for applying the corrected voltage between a pair of electrodes of each pixel of the one of the pixel groups during the predetermined horizontal period in order to reduce non-uniformity of a display.

3. The liquid crystal display apparatus of claim 2, further comprising:

correction signal generating means for generating a correction signal associated with correction of the voltage on the basis of the result of the computing operation and supplying the correction signal to the correction voltage setting means in synchronism with the horizontal period, wherein the correction voltage setting means obtains the correction voltage on the basis of the gradation data and the correction signal every time the correction signal is supplied.

4. The liquid crystal display apparatus of claim 2, further comprising:

a reference power source for generating a predetermined reference voltage, wherein the correction voltage setting means comprises:

reference voltage correcting means for correcting the reference voltage on the basis of the result of the computing operation;

voltage dividing means for dividing the corrected reference voltage to obtain a plurality of divisional voltages in accordance with all the gradations that the pixels can take; and selecting means for selecting from among the plurality of divisional voltages a plurality of divisional voltages in accordance with the gradation represented by each gradation data as the correction voltages.

5. The liquid crystal display apparatus of claim 4, wherein the reference voltage correcting means and the voltage dividing means are formed in a single integrated circuit.

6. A liquid crystal display apparatus comprising:

a liquid crystal panel including a plurality of pixels arranged in a matrix form, the plurality of pixels each including a pair of electrodes and liquid crystal sandwiched therebetween, and being divided into a plurality of pixel groups each including a plurality of pixels, first voltage holding means for causing one of the pair of the electrodes of each of all the pixels to hold a first voltage that is changed at intervals of a predetermined horizontal period;

computing means including an adding circuit which performs a computing operation by adding gradation representative of gradations of pixels of one of the pixel groups at intervals of a predetermined horizontal period;

second voltage setting means for obtaining at intervals of the predetermined horizontal period a second voltage by correcting on the basis of a result of the predetermined computing operation performed by the computing means, the second voltage determined from the gradation data and the first voltage; and second voltage holding means for causing the other one of the pair of electrodes of each of the pixels in one of the pixel groups to hold the second voltage during the predetermined period in order to reduce non-uniformity of a display.

* * * * *